US011484183B2

(12) United States Patent
Boyer et al.

(10) Patent No.: US 11,484,183 B2
(45) **Date of Patent: *Nov. 1, 2022**

(54) DISHWASHER WITH IMAGE-BASED OBJECT SENSING

(71) Applicant: Midea Group Co., Ltd., Foshan (CN)

(72) Inventors: Joel Boyer, Louisville, KY (US); Robert M. Digman, Goshen, KY (US); Bassam Fawaz, Louisville, KY (US); Russell Dietrich, Taylorsville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 100 days.

This patent is subject to a terminal disclaimer.

(21) Appl. No.: 16/588,969

(22) Filed: Sep. 30, 2019

(65) Prior Publication Data

US 2021/0093154 A1 Apr. 1, 2021

(51) Int. Cl.

| | |
|---|---|
| ***A47L 15/42*** | (2006.01) |
| ***A47L 15/44*** | (2006.01) |
| ***A47L 15/46*** | (2006.01) |
| *A47L 15/00* | (2006.01) |

(52) U.S. Cl.

CPC ..... *A47L 15/4295* (2013.01); *A47L 15/4293* (2013.01); *A47L 15/449* (2013.01); *A47L 15/46* (2013.01); *A47L 15/0028* (2013.01); *A47L 15/0063* (2013.01); *A47L 15/4282* (2013.01); *A47L 2401/04* (2013.01); *A47L 2401/34* (2013.01); *A47L 2501/20* (2013.01)

(58) Field of Classification Search

CPC ..... A47L 15/4282; A47L 15/4295; A47L 15/4293; A47L 15/46; A47L 15/449; A47L 2401/34; A47L 15/0028; A47L 2401/04; A47L 2501/20; A47L 15/0063

See application file for complete search history.

(56) References Cited

U.S. PATENT DOCUMENTS

| | | | |
|---|---|---|---|
| 2,734,520 | A | 2/1956 | Abresch |
| 2,808,063 | A | 10/1957 | Abresch et al. |
| 2,939,465 | A | 6/1960 | Kesling |
| 2,956,572 | A | 10/1960 | Levit et al. |
| 2,973,907 | A | 3/1961 | Abresch et al. |
| 2,980,120 | A | 4/1961 | Jacobs |
| 3,006,557 | A | 10/1961 | Jacobs |
| 3,026,046 | A | 3/1962 | Wickham et al. |
| 3,044,842 | A | 7/1962 | Abresch et al. |
| 3,051,183 | A | 8/1962 | Jacobs |
| 3,082,779 | A | 3/1963 | Jacobs |

(Continued)

FOREIGN PATENT DOCUMENTS

| | | | |
|---|---|---|---|
| CN | 2094961 | U | 2/1992 |
| CN | 1879547 | A | 12/2006 |

(Continued)

OTHER PUBLICATIONS

U.S. Patent and Trademark Office, Notice of Allowance issued in U.S. Appl. No. 16/689,528 dated Oct. 7, 2021.

(Continued)

*Primary Examiner* — Benjamin L Osterhout

(74) *Attorney, Agent, or Firm* — Middleton Reutlinger

(57) ABSTRACT

Image-based object sensing is utilized in a dishwasher to configure a wash cycle and/or perform other operations in the dishwasher.

21 Claims, 19 Drawing Sheets

(56) References Cited

U.S. PATENT DOCUMENTS 3,088,474 A 5/1963 Leslie
3,101,730 A 8/1963 Harris et al.
3,115,306 A 12/1963 Graham
3,178,117 A 4/1965 Hanifan
3,192,935 A 7/1965 Hanifan
3,210,010 A 10/1965 Delapena
3,324,867 A 6/1967 Freese
3,348,775 A 10/1967 Flame
3,361,361 A 1/1968 Schutte
3,454,784 A 7/1969 Wantz et al.
3,538,927 A 11/1970 Harald
3,586,011 A 6/1971 Mazza
3,590,688 A 7/1971 Brannon
3,596,834 A 8/1971 Cushing
3,719,323 A 3/1973 Raiser
3,888,269 A 6/1975 Bashark
4,175,575 A 11/1979 Cushing
4,226,490 A 10/1980 Jenkins et al.
4,398,562 A 8/1983 Saarem et al.
4,718,440 A 1/1988 Hawker et al.
4,732,323 A 3/1988 Jarvis et al.
5,131,419 A 7/1992 Roberts
5,211,190 A 5/1993 Johnson et al.
5,226,454 A 7/1993 Cabalfin
5,291,626 A 3/1994 Molnar et al.
5,341,827 A 8/1994 Kim
5,477,576 A 12/1995 Berkcan
5,586,567 A 12/1996 Smith et al.
5,697,392 A 12/1997 Johnson et al.
5,725,002 A 3/1998 Payzant
5,800,628 A 9/1998 Erickson et al.
6,053,185 A 3/2000 Cirjak et al.
6,431,188 B1 8/2002 Laszczewski, Jr. et al.
6,675,818 B1 1/2004 Schrott et al.
6,694,990 B2 2/2004 Spanyer et al.
6,869,029 B2 3/2005 Ochoa et al.
7,055,537 B2 6/2006 Elick et al.
7,210,315 B2 5/2007 Castelli et al.
7,293,435 B2 11/2007 Elexpuru et al.
7,445,013 B2 11/2008 VanderRoest et al.
7,464,718 B2 12/2008 McIntyre et al.
7,556,049 B2 7/2009 Oakes et al.
7,578,303 B2 8/2009 Daume et al.
7,587,916 B2 9/2009 Rizzetto
7,594,513 B2 9/2009 VanderRoest et al.
7,607,325 B2 10/2009 Elexpuru et al.
7,650,765 B2 1/2010 Rizzetto
7,842,137 B2 11/2010 Classen et al.
7,914,625 B2 3/2011 Bertsch et al.
7,935,194 B2 5/2011 Rolek
7,959,744 B2 6/2011 Sundaram et al.
8,136,537 B2 3/2012 Cerrano et al.
8,191,560 B2 6/2012 Mallory et al.
8,229,161 B2 7/2012 Hudnut et al.
8,443,765 B2 5/2013 Hollis
8,509,473 B2 8/2013 Ashrafzadeh et al.
8,696,827 B2 4/2014 Buddharaju et al.
8,858,729 B2 10/2014 Büsing et al.
8,900,375 B2 12/2014 Beaudet et al.
8,915,257 B2 12/2014 Buesing
8,932,411 B2 1/2015 Pyo et al.
8,978,674 B2 3/2015 Wagner
8,985,128 B2 3/2015 Ashrafzadeh et al.
9,121,217 B1 9/2015 Hoffberg
9,170,584 B2 10/2015 Lum et al.
9,204,780 B2 12/2015 Francisco et al.
9,220,393 B2 12/2015 Becker et al.
9,241,604 B2 1/2016 Dries
9,259,137 B2 2/2016 Boyer et al.
9,265,400 B2 2/2016 Bigott
9,271,626 B2 3/2016 Dalton
9,307,888 B2 4/2016 Baldwin et al.
9,326,657 B2 5/2016 Thiyagarajan
9,468,956 B2 10/2016 Simundic et al.
9,480,389 B2 11/2016 Haft et al.
9,492,055 B2 11/2016 Feddema
9,532,700 B2 1/2017 Welch
9,635,994 B2 5/2017 Boyer et al.
9,649,008 B2 5/2017 Kim et al.
9,655,496 B2 5/2017 Baldwin et al.
9,763,552 B2 9/2017 Chapman et al.
9,915,356 B2 3/2018 Chang et al.
9,958,073 B2 5/2018 Yang
9,993,134 B2 6/2018 Dreossi et al.
10,080,477 B2 9/2018 Fauth et al.
10,105,031 B2 10/2018 Dreossi et al.
10,169,881 B2 1/2019 Karasawa
10,307,035 B2 6/2019 Chen et al.
11,191,416 B2 * 12/2021 Fawaz ..... A47L 15/22
2002/0062849 A1 5/2002 Ekelhoff
2002/0185162 A1 12/2002 Rosenbauer et al.
2003/0034052 A1 2/2003 Kiesler et al.
2004/0079400 A1 4/2004 Young
2005/0011544 A1 1/2005 Rosenbauer et al.
2005/0139240 A1 6/2005 Bong et al.
2005/0155393 A1 7/2005 Wright et al.
2005/0231716 A1 10/2005 Ryu et al.
2005/0241680 A1 11/2005 Noh
2005/0241681 A1 11/2005 Hwang
2006/0278258 A1 12/2006 Kara et al.
2007/0046942 A1 3/2007 Ng et al.
2007/0118638 A1 5/2007 Ban et al.
2007/0181162 A1 8/2007 Classen et al.
2007/0272272 A1 11/2007 Choi et al.
2008/0128001 A1 6/2008 Kennichi et al.
2008/0163904 A1 7/2008 Hwang
2008/0271765 A1 11/2008 Burrows
2008/0276975 A1 11/2008 Disch
2009/0071508 A1 3/2009 Sundaram et al.
2009/0090400 A1 4/2009 Burrows et al.
2009/0145468 A1 6/2009 Chericoni
2009/0178698 A1 7/2009 Delgado
2009/0231581 A1 9/2009 Han et al.
2010/0043826 A1 2/2010 Bertsch et al.
2010/0175718 A1 7/2010 Kedjierski et al.
2010/0294311 A1 11/2010 Classen et al.
2011/0000511 A1 1/2011 Mersch et al.
2011/0017235 A1 1/2011 Berner et al.
2011/0186085 A1 8/2011 Chen et al.
2012/0060875 A1 3/2012 Fauth et al.
2012/0138092 A1 6/2012 Ashrafzadeh et al.
2012/0175431 A1 7/2012 Althammer et al.
2012/0291827 A1 11/2012 Buddharaju et al.
2013/0000762 A1 1/2013 Buddharaju et al.
2013/0171023 A1 7/2013 Ben-shmuel et al.
2013/0319483 A1 12/2013 Welch
2014/0059880 A1 3/2014 Bertsch et al.
2014/0069462 A1 3/2014 Becker et al.
2014/0069470 A1 3/2014 Baldwin et al.
2014/0111071 A1 4/2014 Bhajak et al.
2014/0190519 A1 7/2014 Simundic et al.
2014/0373876 A1 12/2014 Feddema
2015/0002658 A1 1/2015 Jaw et al.
2015/0007861 A1 1/2015 Azmi et al.
2015/0201823 A1 7/2015 Poojary et al.
2015/0266065 A1 9/2015 Savoia
2016/0096020 A1 4/2016 Smith
2016/0198928 A1 7/2016 Xu et al.
2016/0296097 A1 10/2016 Dreossi et al.
2016/0324396 A1 * 11/2016 Hong ..... A47L 15/16
2016/0367107 A1 12/2016 Ellingson et al.
2017/0097224 A1 4/2017 Lucas et al.
2017/0135550 A1 5/2017 Shin et al.
2017/0172371 A1 6/2017 Engesser et al.
2017/0181599 A1 6/2017 Choi et al.
2017/0202426 A1 7/2017 Bosen et al.
2017/0224190 A1 8/2017 Sakthivel et al.
2017/0231464 A1 8/2017 Kong et al.
2017/0273535 A1 9/2017 Roderick et al.
2017/0332877 A1 11/2017 Pers et al.
2017/0354308 A1 12/2017 Choi et al.
2018/0036889 A1 2/2018 Birkmeyer et al.
2018/0084967 A1 3/2018 Ross et al.
2018/0107879 A1 4/2018 Laput et al.

(56) References Cited

U.S. PATENT DOCUMENTS

| | | | |
|---|---|---|---|
| 2018/0110397 | A1 | 4/2018 | Kim et al. |
| 2018/0132692 | A1 | 5/2018 | Dries |
| 2018/0133583 | A1 | 5/2018 | Tran et al. |
| 2018/0168425 | A1 | 6/2018 | Wilson et al. |
| 2018/0192851 | A1 | 7/2018 | Gursoy et al. |
| 2018/0304293 | A1 | 10/2018 | Orla-jensen et al. |
| 2019/0099054 | A1 | 4/2019 | Digman et al. |
| 2019/0191959 | A1 | 6/2019 | Brightbill et al. |
| 2019/0290094 | A1 | 9/2019 | Balinski et al. |
| 2019/0290095 | A1 | 9/2019 | Wahlberg et al. |
| 2019/0380559 | A1 | 12/2019 | Lee et al. |
| 2020/0000310 | A1 | 1/2020 | Chu |
| 2020/0138261 | A1 | 5/2020 | Terrádez et al. |
| 2020/0138263 | A1 | 5/2020 | Terrádez et al. |
| 2020/0163526 | A1 | 5/2020 | Yoon et al. |
| 2021/0068612 | A1 | 3/2021 | Park |
| 2021/0093149 | A1 | 4/2021 | Fawaz et al. |
| 2021/0093151 | A1 | 4/2021 | Boyer et al. |
| 2021/0093152 | A1 | 4/2021 | Boyer et al. |
| 2021/0093153 | A1 | 4/2021 | Boyer et al. |
| 2021/0093155 | A1 | 4/2021 | Boyer |
| 2021/0145240 | A1 | 5/2021 | Fawaz |
| 2021/0145241 | A1 | 5/2021 | Dietrich et al. |
| 2022/0110502 | A1 | 4/2022 | Dietrich et al. |

FOREIGN PATENT DOCUMENTS

| | | | |
|---|---|---|---|
| CN | 101134198 | A | 3/2008 |
| CN | 201067392 | Y | 6/2008 |
| CN | 101795613 | A | 8/2010 |
| CN | 102370450 | A | 3/2012 |
| CN | 102512128 | A | 6/2012 |
| CN | 102940476 | A | 2/2013 |
| CN | 203447254 | U | 2/2014 |
| CN | 203749364 | U | 8/2014 |
| CN | 104523208 | A | 4/2015 |
| CN | 104757921 | A | 7/2015 |
| CN | 204671085 | U | 9/2015 |
| CN | 105147218 | A | 12/2015 |
| CN | 105231971 | A | 1/2016 |
| CN | 205094364 | U | 3/2016 |
| CN | 106419794 | A | 2/2017 |
| CN | 107485356 | A | 12/2017 |
| DE | 3537184 | A1 | 4/1987 |
| DE | 10048081 | A1 | 4/2002 |
| DE | 10121083 | A1 | 10/2002 |
| DE | 10300501 | A1 | 7/2004 |
| DE | 202004013786 | U1 | 11/2004 |
| DE | 102008011743 | A1 | 9/2009 |
| DE | 202014010365 | U1 | 5/2015 |
| DE | 102014215660 | A1 | 1/2016 |
| DE | 102015103040 | A1 | 9/2016 |
| DE | 102016202267 | A1 | 8/2017 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0864291 | A1 | 9/1998 |
| EP | 0943287 | A1 | 9/1999 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1635167 | A1 | 3/2006 |
| EP | 1758494 | A1 | 3/2007 |
| EP | 2636786 | A1 | 9/2013 |
| EP | 2059160 | B1 | 3/2015 |
| EP | 3498145 | A1 | 6/2016 |
| EP | 3427630 | A1 | 1/2019 |
| EP | 3476269 | A1 | 5/2019 |
| FR | 1473796 | A | 3/1967 |
| GB | 572623 | A | 10/1945 |
| GB | 2244209 | A | 11/1991 |
| JP | 2003235781 | A | 8/2003 |
| JP | 2003339607 | A | 12/2003 |
| JP | 2009273490 | A | 11/2009 |
| JP | 2014121353 | A | 7/2014 |
| JP | 2017144240 | A | 8/2017 |
| KR | 100786069 | B1 | 12/2007 |
| KR | 101173691 | B1 | 8/2012 |
| KR | 200464747 | Y1 | 1/2013 |
| KR | 101387609 | B1 | 4/2014 |
| WO | WO2009008827 | A1 | 1/2009 |
| WO | WO2011080232 | A1 | 7/2011 |
| WO | WO2012173479 | A1 | 12/2012 |
| WO | WO2016008699 | A1 | 1/2016 |
| WO | WO2016096020 | A1 | 6/2016 |
| WO | WO2017032629 | A1 | 3/2017 |
| WO | WO2018053635 | A1 | 3/2018 |
| WO | WO2018108285 | A1 | 6/2018 |
| WO | WO2018114363 | A1 | 6/2018 |
| WO | WO2018228679 | A1 | 12/2018 |

OTHER PUBLICATIONS

U.S. Patent and Trademark Office, Corrected Notice of Allowance issued in U.S. Appl. No. 16/587,820 dated Oct. 8, 2021.

U.S. Patent and Trademark Office, Office Action issued in U.S. Appl. No. 16/588,310 dated Oct. 8, 2021.

U.S. Patent and Trademark Office, Office Action issued in U.S. Appl. No. 16/689,528 dated Jun. 9, 2021.

U.S. Patent and Trademark Office, Office Action issued in U.S. Appl. No. 16/588,034 dated Sep. 14, 2020.

U.S. Patent and Trademark Office, Notice of Allowance issued in U.S. Appl. No. 16/587,826 dated Jan. 5, 2022.

U.S. Patent and Trademark Office, Notice of Allowance issued in U.S. Appl. No. 16/689,765 dated Nov. 12, 2021.

U.S. Patent and Trademark Office, Notice of Allowance issued in U.S. Appl. No. 16/587,820 dated Sep. 3, 2021.

U.S. Patent and Trademark Office, Final Office Action issued in U.S. Appl. No. 16/588,135 dated Jan. 27, 2022.

U.S. Patent and Trademark Office, Office Action issued in U.S. Appl. No. 16/588,135 dated Jul. 20, 2021.

U.S. Patent and Trademark Office, Final Office Action issued in U.S. Appl. No. 16/587,826 dated Sep. 21, 2021.

U.S. Patent and Trademark Office, Final Office Action issued in U.S. Appl. No. 16/588,034 dated Dec. 23, 2020.

Sokol "This is What Happens When You Put a Camera in a Dishwasher" https://www.vice.com/en_us/article/wyeyx/this-is-what-the-inside-of-a-dish-washer-cycle-looks-like, Jun. 2014.

"Technology" sensorsllc.com/technology.html, Sensor Systems, 2017.

"Magnet Sensors in Dish washer Spray Arm Jam Detection" https://www.reed-sensor.com/applications/white-goods/spray-arm-jam-detection/ Accessed Jul. 2, 2019.

"Intelligent Dishwasher Outsmarks Dirt" https://www.designnews.com/electronics-test/intelligent-dishwasher-soutsmarts-dirt/151626670139713. Design News, Apr. 1995.

"LG Electronics, LG Connected Appliances Lead Home Kitchens Into the Future: Network of Appliances Offers Seamless Connectivity with LG InstaView ThinQ Refrigerator, EasyClean Oven Range and QuadWash Dishwasher", https://www.prnewswire.com/news-releases/lg-connected-appliances-lead-home-kitchens-into-the-future-300578674, Jan. 7, 2018.

Sears "Kenmore Elite 2013 Stainless Steel Tall Tub Dishwasher Service Manual", Dec. 5, 2018.

DE10121083A1 machine translation (Year: 2002).

Everyspec, Federal Specification: Dishwashing Machines, Single Tank and Double Tank, Commercial, www.everyspec.com, Oct. 17, 1983.

Electrolux Home Products, Inc. "Dishwasher Use & Care Guide 1500 Series with Fully Electronic Control" 2003.

U.S. Patent and Trademark Office, Advisory Action issued in U.S. Appl. No. 16/588,135 dated May 12, 2022.

U.S. Patent and Trademark Office, Notice of Allowance issued in U.S. Appl. No. 16/588,135 dated May 23, 2022.

U.S. Patent and Trademark Office, Final Office Action issued in U.S. Appl. No. 16/588,310 dated Apr. 27, 2022.

(56) References Cited

OTHER PUBLICATIONS

U.S. Patent and Trademark Office, Non-Final Office Action issued in U.S. Appl. No. 16/587,826 dated Apr. 14, 2021.
U.S. Patent and Trademark Office, Notice of Allowance issued in U.S. Appl. No. 16/588,034 dated Apr. 19, 2021.
U.S. Patent and Trademark Office, Office Action issued in U.S. Appl. No. 16/587,820 dated Apr. 19, 2021.
Cormier, David G., United States Patent and Trademark Office, Notice of Allowance issued in U.S. Appl. No. 16/588,310, 37 pages, dated Aug. 24, 2022.

* cited by examiner

DISHWASHER WITH IMAGE-BASED OBJECT SENSING

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the shortcoming of that they must spread the wash fluid over all areas equally to achieve a satisfactory result. In doing so, resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

Various efforts have been made to attempt to customize wash cycles to improve efficiency as well as wash performance, e.g., using cameras and other types of image sensors to sense the contents of a dishwasher, as well as utilizing spray arms that provide more focused washing in particular areas of a dishwasher. Nonetheless, a significant need still exists in the art for greater efficiency and efficacy in dishwasher performance.

SUMMARY

The herein-described embodiments address these and other problems associated with the art by providing image-based object sensing in a dishwasher to configure a wash cycle in various manners.

Therefore, consistent with one aspect of the invention, a dishwasher may include a wash tub, a fluid supply configured to supply fluid to the wash tub, an imaging device configured to capture images in the wash tub, a controllably-movable sprayer in fluid communication with the fluid supply, and a controller coupled to the imaging device and the controllably-movable sprayer, the controller configured to control the imaging device to capture one or more images of an object in the wash tub and to control the controllably-movable sprayer to spray fluid onto the object within a plurality of positions of the controllably-movable sprayer corresponding to one or more boundaries determined for the object from the captured one or more images.

In some embodiments, the controller is further configured to determine the plurality of positions by performing image analysis on the captured one or more images. Also, in some embodiments, the controller is further configured to determine the plurality of positions by communicating the captured one or more images to a remote device that determines the one or more boundaries of the object, and receiving a response associated therewith from the remote device.

Further, in some embodiments, the controllably-movable sprayer includes a tubular spray element disposed in the wash tub and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures, and a tubular spray element drive coupled to the tubular spray element and configured to rotate the tubular spray element between a plurality of rotational positions about the longitudinal axis thereof, where the plurality of positions of the controllably-movable sprayer include first and second rotational positions of the tubular spray element, and where the controller is coupled to the tubular spray element drive and configured to control the controllably-movable sprayer to spray fluid onto the object by controlling the tubular spray element drive to discretely direct the tubular spray element to a rotational position between the first and second rotational positions. In some embodiments, the controller is configured to control the controllably-movable sprayer to spray fluid onto the object by sweeping the tubular spray element between the first and second rotational positions. In addition, in some embodiments, the controller is further configured to control the controllably-movable sprayer based upon a spray pattern determined from one or more images captured from the imaging device.

In some embodiments, the controllably-movable sprayer is a first controllably-movable sprayer and the plurality of positions is a first plurality of positions, the dishwasher further includes a second controllably-movable sprayer, and the controller is configured to control the second controllably-movable sprayer to spray fluid onto the object within a second plurality of positions of the second controllably-movable sprayer corresponding to the one or more boundaries. In addition, in some embodiments, the first and second controllably-movable sprayers are in a same plane. Moreover, in some embodiments, the first and second controllably-movable sprayers are in different planes. In some embodiments, the dishwasher further includes a third controllably-movable sprayer disposed in a different plane from each of the first and second controllably-movable sprayers, and the controller is configured to control the third controllably-movable sprayer to spray fluid onto the object within a third plurality of positions of the third controllably-movable sprayer corresponding to the one or more boundaries. Moreover, in some embodiments, the object is a utensil to be washed. In some embodiments, the object is a component of the dishwasher. In addition, in some embodiments, the object is a silverware basket.

Consistent with another aspect of the invention, a method of operating a dishwasher may include capturing one or more images of an object in the dishwasher using an imaging device, and controlling a controllably-movable sprayer in the dishwasher to spray fluid onto the object within a plurality of positions of the controllably-movable sprayer corresponding to one or more boundaries determined for the object from the captured one or more images.

Consistent with another aspect of the invention, a dishwasher may include a wash tub, a fluid supply configured to supply fluid to the wash tub, an imaging device configured to capture images in the wash tub, a plurality of controllably-movable sprayers in fluid communication with the fluid supply, and a controller coupled to the imaging device and the plurality of controllably-movable sprayers, the controller configured to control the imaging device to capture one or more images of a plurality of zones in the wash tub and to control the plurality of controllably-movable sprayers to perform concurrent wash operations in the plurality of zones using different wash cycle configurations for the plurality of zones and determined using the captured one or more images.

In some embodiments, the controller is further configured to determine the different wash cycle configurations by performing image analysis on the captured one or more images to determine a load configuration for a load in the dishwasher. Moreover, in some embodiments, the controller is further configured to determine the different wash cycle configurations by communicating the captured one or more images to a remote device that determines a load configuration for a load in the dishwasher, and receiving a response associated therewith from the remote device.

Also, in some embodiments, the wash cycle configurations differ from one another based upon wash temperature, operation duration, number of operations, spray pattern, fluid pressure, soak time, or spray isolation. In some embodiments, the wash cycle configurations differ from one another based upon one or more control parameters for the plurality of controllably-movable sprayers, the one or more control parameters including a zone assignment, a sweep, a control path, a rate of movement, or a position.

In addition, in some embodiments, each of the plurality of controllably-movable sprayers includes a tubular spray element disposed in the wash tub and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures, and a tubular spray element drive coupled to the tubular spray element and configured to rotate the tubular spray element between a plurality of rotational positions about the longitudinal axis thereof. Also, in some embodiments, the controller is further configured to determine the plurality of zones for concurrent wash operations based upon resource availability.

Consistent with another aspect of the invention, a method of operating a dishwasher may include capturing one or more images of a plurality of zones in the dishwasher using an imaging device, and controlling a plurality of controllably-movable sprayers in the dishwasher to perform concurrent wash operations in the plurality of zones using different wash cycle configurations for the plurality of zones determined using the captured one or more images.

Consistent with another aspect of the invention, a dishwasher may include a wash tub, a fluid supply configured to supply fluid to the wash tub, an imaging device configured to capture images in the wash tub, a plurality of controllably-movable sprayers in fluid communication with the fluid supply, where at least one of the plurality of controllably-movable sprayers is a multi-zone sprayer configurable to spray fluid into each of first and second zones in the wash tub, and a controller coupled to the imaging device and the plurality of controllably-movable sprayers, the controller configured to control the imaging device to capture one or more images of the first and second zones in the wash tub and to assign the multi-zone sprayer to one of the first and second zones based upon a load configuration for a load in the dishwasher and determined from the captured one or more images, where the controller is further configured to perform concurrent wash operations in the first and second zones by controlling controllably-movable sprayers among the plurality of controllably-movable sprayers to concurrently spray fluid into each of the first and second zones, and where the controller is further configured to control the multi-zone sprayer to spray fluid into the assigned one of the first and second zones when performing the concurrent wash operations.

Moreover, in some embodiments, the controller is further configured to determine the load configuration by performing image analysis on the captured one or more images. Further, in some embodiments, the controller is further configured to determine the load configuration by communicating the captured one or more images to a remote device that determines the load configuration, and receiving a response associated therewith from the remote device. Also, in some embodiments, the determined load configuration for the first zone includes an object count, a density, a class for a first object assigned to the first zone, a location for the first object, a boundary for the first object, a class for the first object, a type for the first object, a material for the first object, a soil spot on the first object, a location of the soil spot on the first object, a boundary of the soil spot on the first object, or a type of the soil spot on the first object. Further, in some embodiments, each of the plurality of controllably-movable sprayers includes a tubular spray element disposed in the wash tub and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures, and a tubular spray element drive coupled to the tubular spray element and configured to rotate the tubular spray element between a plurality of rotational positions about the longitudinal axis thereof. In some embodiments, the controller is further configured to assign the multi-zone sprayer based upon resource availability.

Consistent with another aspect of the invention, a method of operating a dishwasher may include capturing one or more images of a plurality of zones in the dishwasher using an imaging device, performing concurrent wash operations in first and second zones of the dishwasher by controlling a plurality of controllably-movable sprayers in the dishwasher to concurrently spray fluid into each of the first and second zones, where at least one of the plurality of controllably-movable sprayers is a multi-zone sprayer configurable to spray fluid into each of the first and second zones, assigning the multi-zone sprayer to one of the first and second zones based upon a load configuration for a load in the dishwasher and determined from the captured one or more images, and controlling the multi-zone sprayer to spray fluid into the assigned one of the first and second zones when performing the concurrent wash operations.

Consistent with another aspect of the invention, a dishwasher may include a wash tub, a fluid supply configured to supply fluid to the wash tub, an imaging device configured to capture images in the wash tub, a controllably-movable sprayer in fluid communication with the fluid supply, and a controller coupled to the imaging device and the plurality of controllably-movable sprayers, the controller configured to control the imaging device to capture one or more images of first and second zones in the wash tub, and to restrict a control path of the controllably-movable sprayer to spray fluid into the first zone while avoiding spraying fluid into the second zone based upon a determination made using the captured one or more images that the first zone is a high wash strength zone and the second zone is a low wash strength zone.

Also, in some embodiments, the controller is further configured to restrict the range of motion of the controllably-movable sprayer by performing image analysis on the captured one or more images to determine a load configuration for a load in the dishwasher. In some embodiments, the controller is further configured to restrict the range of motion of the controllably-movable sprayer by communicating the captured one or more images to a remote device that determines a load configuration for a load in the dishwasher, and receiving a response associated therewith from the remote device. Further, in some embodiments, the controller is further configured to assign a number of controllably-movable sprayers, control a fluid pressure or control a temperature used when spraying fluid into the first zone based upon the determination that the first zone is a high wash strength zone.

In some embodiments, the controller is further configured to reassign one of a plurality of controllably-movable sprayers to a different zone based upon the determination that the first zone is a high wash strength zone and the second zone is a low wash strength zone. Further, in some embodiments, each of the plurality of controllably-movable sprayers includes a tubular spray element disposed in the wash tub and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures, and a tubular spray element drive coupled to the tubular spray element and configured to rotate the tubular spray element between a plurality of rotational positions about the longitudinal axis thereof. Also, in some embodiments, the first zone is determined to be a high wash strength zone based upon detection of one or more cooking containers in the first zone and the second zone is determined to be a low wash strength zone based upon detection of glassware in the second zone.

Consistent with another aspect of the invention, a method of operating a dishwasher may include capturing one or more images of first and second zones in the dishwasher using an imaging device, performing a wash operation by controlling a controllably-movable sprayer in the dishwasher to spray fluid into the first zone, and restricting a control path of the controllably-movable sprayer to spray fluid into the first zone while avoiding spraying fluid into the second zone based upon a determination made using the captured one or more images that the first zone is a high wash strength zone and the second zone is a low wash strength zone.

Consistent with another aspect of the invention, a dishwasher may include a wash tub, a fluid supply configured to supply fluid to the wash tub, an imaging device configured to capture images in the wash tub, a controllably-movable sprayer in fluid communication with the fluid supply, the controllably-movable sprayer being configurable to emit fluid in a plurality of spray patterns, and a controller coupled to the imaging device and the controllably-movable sprayer, the controller configured to control the imaging device to capture one or more images in the wash tub and assign one of the plurality of spray patterns for the controllably-movable sprayer based upon a load configuration for a load in the dishwasher and determined from the captured one or more images, where the controller is further configured to control the controllably-movable sprayer to spray fluid using the assigned spray pattern.

In addition, in some embodiments, the controller is further configured to determine the load configuration by performing image analysis on the captured one or more images. In some embodiments, the controller is further configured to determine the load configuration by communicating the captured one or more images to a remote device that determines the load configuration, and receiving a response associated therewith from the remote device. In addition, in some embodiments, the controllably-movable sprayer is configured to vary the spray pattern based on fluid pressure supplied to the controllably-movable sprayer, and the controller is configured to control the controllably-movable sprayer to spray fluid using the assigned spray pattern by controlling the fluid pressure supplied to the controllably-movable sprayer.

Also, in some embodiments, the controllably-movable sprayer is positioned to spray fluid into an interior of a drinkware item, and the assigned spray pattern is a narrow spray pattern to facilitate washing of the interior of the drinkware item. In addition, in some embodiments, the controllably-movable sprayer is positioned to spray fluid onto an exterior of a drinkware item, and the assigned spray pattern is a wide spray pattern to minimize disturbing the drinkware item. In some embodiments, each of the plurality of controllably-movable sprayers includes a tubular spray element disposed in the wash tub and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures, and a tubular spray element drive coupled to the tubular spray element and configured to rotate the tubular spray element between a plurality of rotational positions about the longitudinal axis thereof.

Consistent with another aspect of the invention, a method of operating a dishwasher may include capturing one or more images in the dishwasher using an imaging device, performing a wash operation by controlling a controllably-movable sprayer in the dishwasher to spray fluid into the dishwasher, where the controllably-movable sprayer is configurable to emit fluid in a plurality of spray patterns, assigning one of the plurality of spray patterns for the controllably-movable sprayer based upon a load configuration for a load in the dishwasher and determined from the captured one or more images, and controlling the controllably-movable sprayer during the wash operation to spray fluid using the assigned spray pattern.

Consistent with another aspect of the invention, a dishwasher may include a wash tub, a fluid supply configured to supply fluid to the wash tub, a controllably-movable sprayer, and a controller coupled to the controllably-movable sprayer and configured to control the controllably-movable sprayer to spray fluid onto a soil spot on a utensil disposed in the wash tub during a wash cycle.

Some embodiments may further include an imaging device configured to capture images of the utensil, where the controller is coupled to the imaging device and configured to control the controllably-movable sprayer to spray fluid onto the soil spot based upon a location of the soil spot determined from one or more images of the utensil captured by the imaging device. In addition, in some embodiments, the controller is configured to determine the location of the soil spot from the captured one or more images. Further, in some embodiments, the controller is configured to communicate the captured one or more images to a remote device that determines the location of the soil spot, and receive the location of the soil spot from the remote device.

Moreover, in some embodiments, the controller is further configured to control the imaging device to capture one or more additional images after spraying fluid onto the soil spot. Further, in some embodiments, the controller is configured to change a direction of the controllably-movable sprayer in response to a change in location or size of the soil spot determined from the one or more additional images. In some embodiments, the controller is configured to discontinue spraying by the controllably-movable sprayer in response to a determination from the one or more additional images that washing of the soil spot is complete. Moreover, in some embodiments, the controller is configured to redirect the controllably-movable sprayer to spray fluid at a second soil spot in response to a determination from the one or more additional images that washing of the soil spot is complete. Further, in some embodiments, the control is further configured to vary a soak time, a fluid pressure, a duration, a number of operations, or a temperature based upon a soil type determined from the captured one or more images.

In addition, in some embodiments, the controllably-movable sprayer includes a tubular spray element disposed in the wash tub and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures, and a tubular spray element drive coupled to the tubular spray element and configured to rotate the tubular spray element between a plurality of rotational positions about the longitudinal axis thereof, where the controller is coupled to the tubular spray element drive and configured to control the tubular spray element drive to discretely direct the tubular spray element to spray fluid on the soil spot.

Consistent with another aspect of the invention, a method of operating a dishwasher may include controlling a controllably-movable sprayer in the dishwasher to spray fluid onto one or more utensils disposed in a wash tub of the dishwasher, and controlling the controllably-movable sprayer to spray fluid onto a soil spot on one of the one or more utensils.

Consistent with another aspect of the invention, a dishwasher may include a wash tub including a sump, an imaging device configured to capture images of the sump, and a controller coupled to the imaging device and configured to control the imaging device to capture one or more images of the sump and generate a notification in response to detection of a foreign object in the sump from the captured one or more images of the sump.

In addition, some embodiments may also include a heating element in the sump, and the foreign object is a plastic utensil. Also, in some embodiments, the controller is configured to detect the foreign object from the captured one or more images. Moreover, in some embodiments, the controller is configured to communicate the captured one or more images to a remote device that detects the foreign object. In some embodiments, generating the notification includes incorporating a captured image of the foreign object in the sump into the notification. Further, in some embodiments, generating the notification further includes highlighting the foreign object in the captured image.

Consistent with another aspect of the invention, a method of operating a dishwasher may include capturing one or more images of a sump of the dishwasher using an imaging device, detecting a foreign object in the sump, and generating a notification in response to detecting the foreign object.

Consistent with another aspect of the invention, a dishwasher may include a wash tub, a door providing external access to the wash tub, an imaging device configured to capture images in the dishwasher, and controller coupled to the imaging device and configured to control the imaging device to capture one or more images of a load in the dishwasher at an end of a wash cycle, set a clean status for the dishwasher at the end of the wash cycle, sense a change in state for the dishwasher based at least in part on one or more subsequent images captured with the imaging device after the door has been opened, and generate a notification of the change of state in response to sensing the change of state.

Also, in some embodiments, the controller is configured to sense the change in state at least in part based upon one or more of the subsequent images indicating that the dishwasher is empty. Further, in some embodiments, the controller is configured to sense the change in state at least in part based upon one or more of the subsequent images indicating that one or more objects have been added to the dishwasher. Also, in some embodiments, the controller is configured to include an image of the one or more objects added to the dishwasher in the notification. In addition, in some embodiments, the controller is configured to highlight the one or more objects added to the dishwasher in the image included in the notification.

Moreover, in some embodiments, the controller is configured to sense the change in state at least in part based upon a time between the door being opened and the door being closed after completion of the wash cycle. In some embodiments, the change in state is a dirty state. Further, in some embodiments, the controller is configured to maintain the clean state for the dishwasher in response to one or more of the subsequent images indicating that one or more objects have been removed from the dishwasher but no objects have been added to the dishwasher.

In some embodiments, the controller is configured to sense the change in state for the dishwasher by performing image analysis on the one or more subsequent images. Moreover, in some embodiments, the controller is configured to sense the change in state by communicating the one or more subsequent images to a remote device that performs image analysis thereon, and receiving a response indicating the change in state from the remote device.

Consistent with another aspect of the invention, a method of operating a dishwasher may include capturing one or more images of a load in the dishwasher at an end of a wash cycle using an imaging device, setting a clean status for the dishwasher at the end of the wash cycle, sensing a change in state for the dishwasher based at least in part on one or more subsequent images captured with the imaging device after a door of the dishwasher has been opened, and generating a notification of the change of state in response to sensing the change of state.

Consistent with another aspect of the invention, a dishwasher may include a wash tub, a door providing external access to the wash tub, an imaging device configured to capture images in the dishwasher, and a controller coupled to the imaging device and configured to control the imaging device to capture one or more images of a load in the dishwasher at an end of a wash cycle and generate a notification of an object added to the dishwasher after the end of the wash cycle and prior to emptying of the dishwasher based at least in part on one or more subsequent images captured with the imaging device after the door has been opened.

Consistent with another aspect of the invention, a method of operating a dishwasher may include capturing one or more images of a load in the dishwasher at an end of a wash cycle using an imaging device, and generating a notification of an object added to the dishwasher after the end of the wash cycle and prior to emptying of the dishwasher based at least in part on one or more subsequent images captured with the imaging device after the door has been opened.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
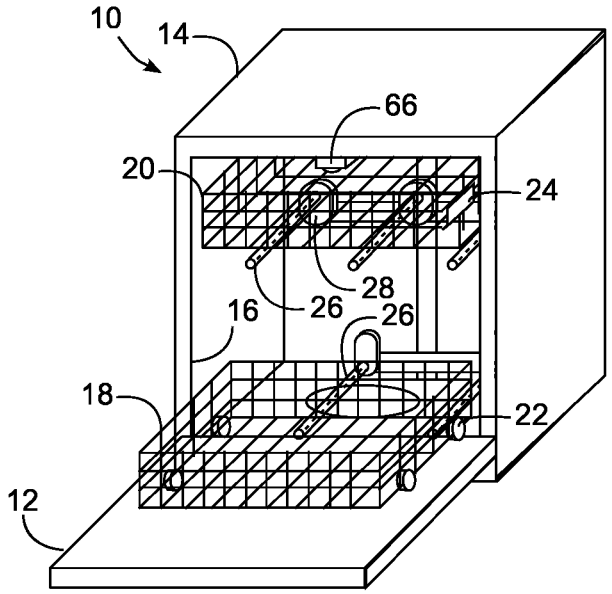
FIG. 1 is a perspective view of a dishwasher consistent with some embodiments of the invention.

In various embodiments discussed hereinafter, an imaging system may be used within a dishwasher to perform various operations within the dishwasher. An imaging system, in this regard, may be considered to include one or more cameras or other imaging devices capable of capturing images within a dishwasher. The images may be captured in the visible spectrum in some embodiments, while in other embodiments other spectrums may be captured, e.g., the infrared spectrum. Imaging devices may be positioned in fixed locations within a dishwasher in some embodiments, and in other embodiments may be positioned on movable and/or controllable components, as will become more apparent below. In addition, captured images may be analyzed locally within a dishwasher in some embodiments, while in other embodiments captured images may be analyzed remotely, e.g., using a cloud-based service. Furthermore, imaging devices may generate two dimensional images in some embodiments, while in other embodiments captured images may be three dimensional in nature, e.g., to enable surface models to be generated for structures within a dishwasher, including both components of the dishwasher and articles placed in the dishwasher to be washed. Images may also be combined in some embodiments, and in some embodiments multiple images may be combined into videos clips prior to analysis.

In some embodiments consistent with the invention, and as will become more apparent below, an imaging system may be utilized in connection with one or more controllable sprayers. A controllable sprayer, in this regard, may refer to a component capable of selectively generating a spray of fluid towards any of a plurality of particular spots, locations, or regions of a dishwasher, such that through control of the sprayer, fluid may be selectively sprayed into different spots, locations or regions as desired. When paired with an imaging system consistent with the invention, therefore, a controller of a dishwasher may be capable of controlling one or more controllable sprayers to direct fluid into specific spots, locations or regions based upon images captured by an imaging system.

In some instances, a controllable sprayer may be implemented using multiple nozzles directed at different spots, locations or regions and selectively switchable between active and inactive states. In other embodiments, however, a controllable sprayer may be a controllably-movable sprayer that is capable of being moved, e.g., through rotation, translation or a combination thereof, to direct a spray of fluid to different spots, locations or regions. Moreover, while some controllably-movable sprayers may include designs such as gantry-mounted wash arms or other sprayers, controllably-rotatable wash arms, motorized sprayers, and the like, in some embodiments, a controllably-movable sprayer may be configured as a tubular spray element that is rotatable about a longitudinal axis and discretely directed through each of a plurality of rotational positions about the longitudinal axis by a tubular spray element drive to spray a fluid such as a wash liquid and/or pressurized air in a controlled direction generally transverse from the longitudinal axis about which the tubular spray element rotates.

A tubular spray element, in this regard, may be considered to include an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates, and furthermore, a tubular spray element drive is coupled to the tubular spray element to discretely direct the tubular spray element to multiple rotational positions about the longitudinal axis. In addition, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, a tubular spray element may be mounted on a movable portion of the dishwasher, e.g., a rack, and may be operably coupled to such a drive through a docking arrangement that both rotates the tubular spray element and supplies fluid to the tubular spray element when the tubular spray element is docked in the docking arrangement. In other embodiments, however, a tubular spray element may be mounted to a fixed portion of a dishwasher, e.g., a wash tub wall, whereby no docking arrangement is used. Further details regarding tubular spray elements may be found, for example, in U.S. Pub. No. 2019/0099054 filed by Digman et al., which is incorporated by reference herein.

It will be appreciated, however, that an imaging system consistent with the invention may, in some instances, be used in a dishwasher having other types of spray elements, e.g., rotatable spray arms, fixed sprayers, etc., as well as in a dishwasher having spray elements that are not discretely directable or otherwise controllable or controllably-movable. Therefore, the invention is not limited in all instances to use in connection with the various types of sprayers described herein.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
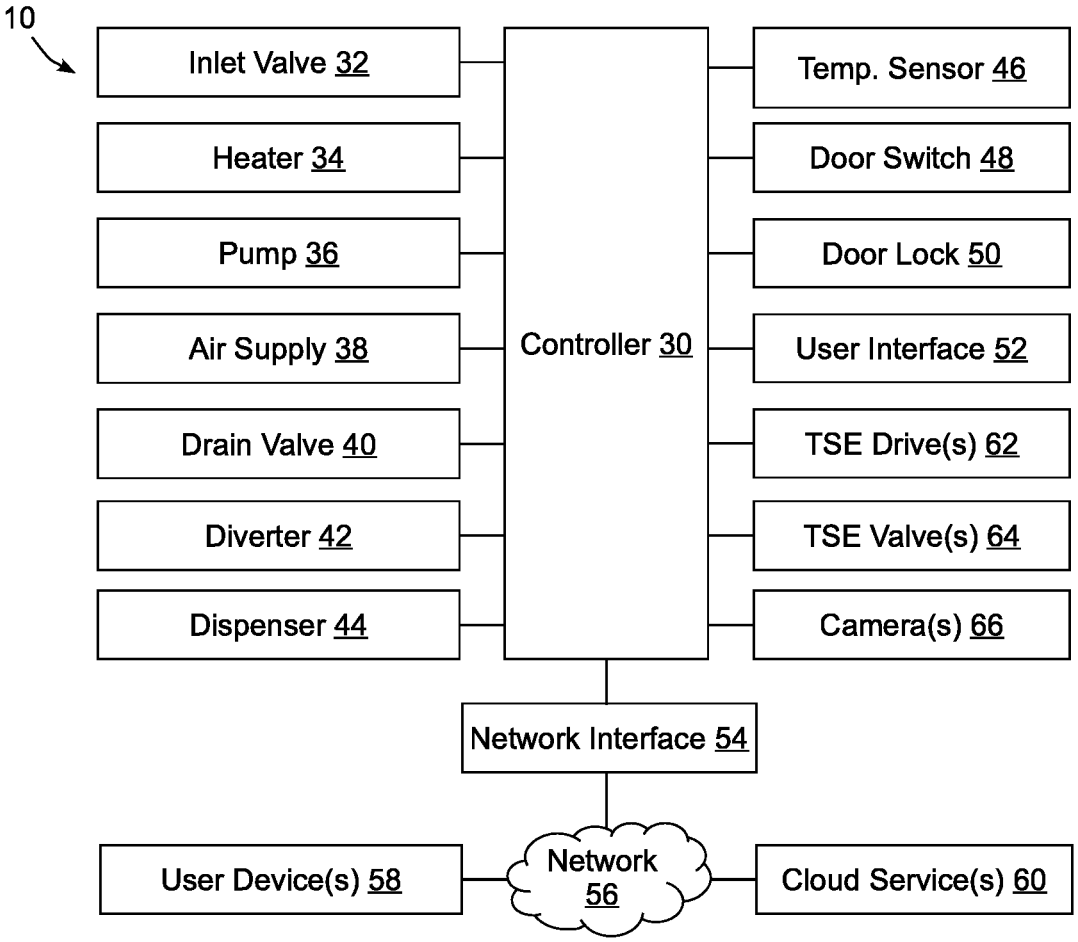
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances, and thus a fluid supply in some embodiments may supply various liquid wash fluids to various sprayers in the dishwasher. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks 56 such as Ethernet, Bluetooth, NFC, cellular and other suitable networks. External devices may include, for example, one or more user devices 58, e.g., mobile devices, desktop computers, etc., and one or more cloud services 60, e.g., as may be provided by a manufacturer of dishwasher 10. Other types of devices, e.g., devices associated with maintenance or repair personnel, may also interface with dishwasher 10 in some embodiments.

Additional components may also be interfaced with controller 30, as will be appreciated by those of ordinary skill having the benefit of the instant disclosure. For example, one or more tubular spray element (TSE) drives 62 and/or one or more tubular spray element (TSE) valves 64 may be provided in some embodiments to discretely control one or more tubular spray elements disposed in dishwasher 10, as will be discussed in greater detail below. Further, an imaging system including one or more cameras 66 (see also FIG. 1 for an example physical location of a camera 66 in dishwasher 10) may also be provided in some embodiments to provide visual information suitable for implementing some of the functionality described herein.

It will be appreciated that each tubular spray element drive 62 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 64 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a user device 58, a cloud service 60, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Furthermore, additional details regarding the concepts disclosed herein may also be found in the following co-pending applications, all of which were filed on even date herewith, and all of which are incorporated by reference herein: U.S. application Ser. No. 16/588,034 (now issued as U.S. Pat. No. 11,026 559), entitled "DISHWASHER WITH IMAGE-BASED FLUID CONDITION SENSING," U.S. application Ser. No. 16,588,135 (now issued as U.S. Pat. No. 11,399,690, entitled "DISHWASHER WITH CAM-BASED POSITION SENSOR," U.S. App. No. 16/587,820 (now issued as U.S. Pat. No. 11,191,416), entitled "DISHWASHER WITH IMAGE-BASED POSITION SENSOR," U.S. App. Ser. No. 16/588,310, entitled "DISHWASHER WITH IMAGE-BASED DETERGENT SENSING," and U.S. application Ser. No. 16/587,826 (now issued as U.S. Pat. No. 11,259,681, entitled "DISHWASHER WITH IMAGE-BASED DIAGNOSTICS."

Tubular Spray Elements

Figure 3:
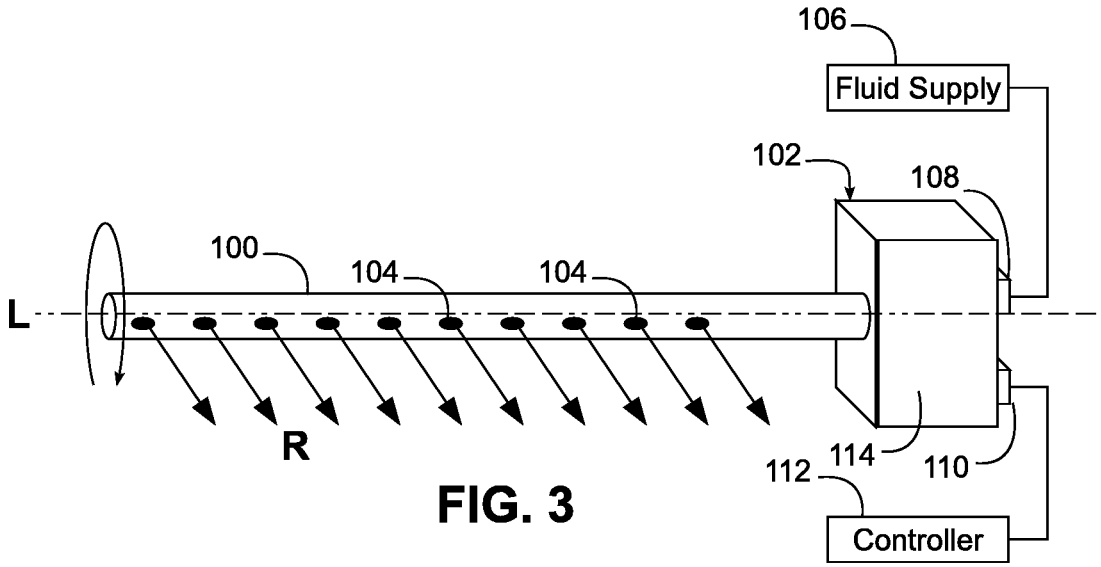
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element may be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
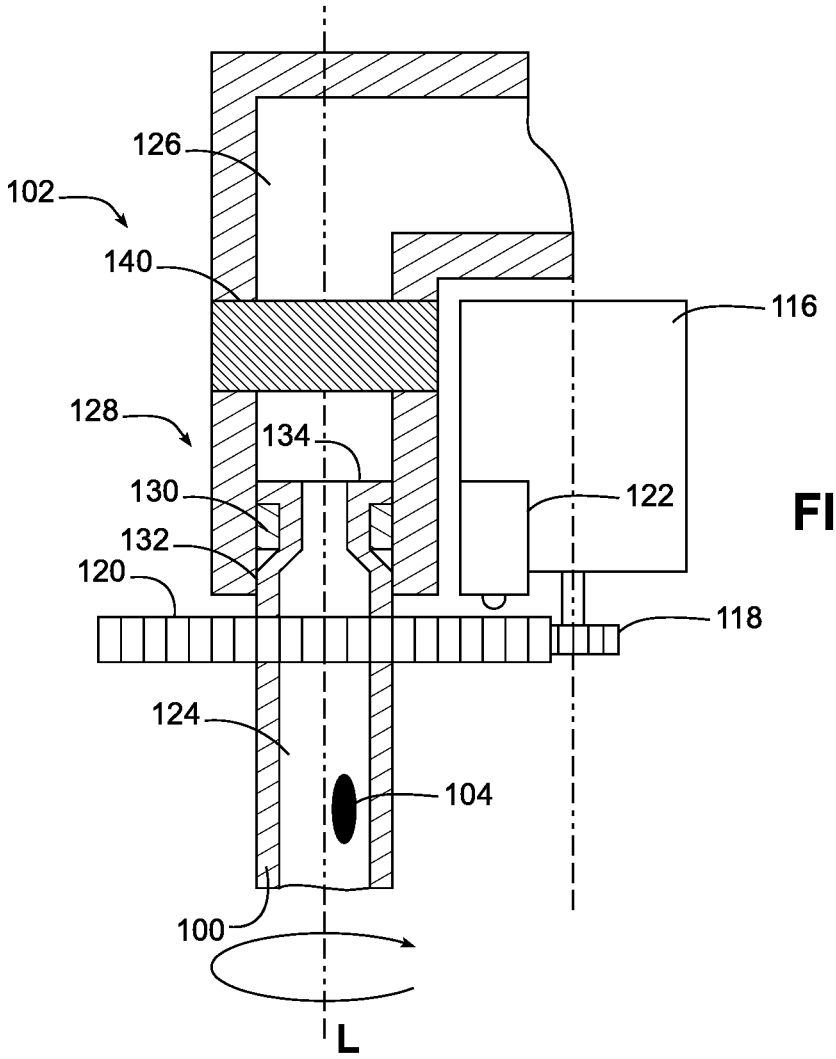
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pulley drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element, or using one or more microswitches and a cam configured to engage the microswitches at predetermined rotational positions. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

In addition, it also may be desirable in some embodiments to incorporate a valve 140 into a tubular spray element drive 102 to regulate the fluid flow to tubular spray element 100. Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 100 and tubular spray element drive 102. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 100, e.g., using an iris valve, butterfly valve, gate valve, plunger valve, piston valve, valve with a rotatable disk, ball valve, etc., and actuated by a solenoid, motor or other separate mechanism from the mechanism that rotates tubular spray element 100. In other embodiments, however, valve 140 may be actuated through rotation of tubular spray element 100. In some embodiments, for example, rotation of tubular spray element 100 to a predetermined rotational position may be close valve 140, e.g., where valve 140 includes an arcuate channel that permits fluid flow over only a range of rotational positions. As another example, a valve may be actuated through over-rotation of a tubular spray element or through counter rotation of a tubular spray element.

Tubular spray elements may be mounted within a wash tub in various manners in different embodiments, e.g., mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive. Moreover, rather than being mounted in a cantilevered fashion as is the case with tubular spray element 100 of FIG. 3, a tubular spray element may also be mounted on a wall of a wash tub and supported at both ends. In still other embodiments, a tubular spray element may be rack-mounted, with either the associated tubular spray element drive also rack-mounted or alternatively mounted on a wall of the wash tub. It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Additional features that may be utilized in a dishwasher including tubular spray elements are described, for example, in U.S. application Ser. Nos. 16/132,091, 16/132,106, 16/132,114, 16/132,125 filed on Sep. 14, 2018 and U.S. application Ser. No. 16/298,007 filed on Mar. 11, 2019, all of which are all assigned to the same assignee as the present application, and all of which are hereby incorporated by reference herein.

Imaging System

Figure 5:
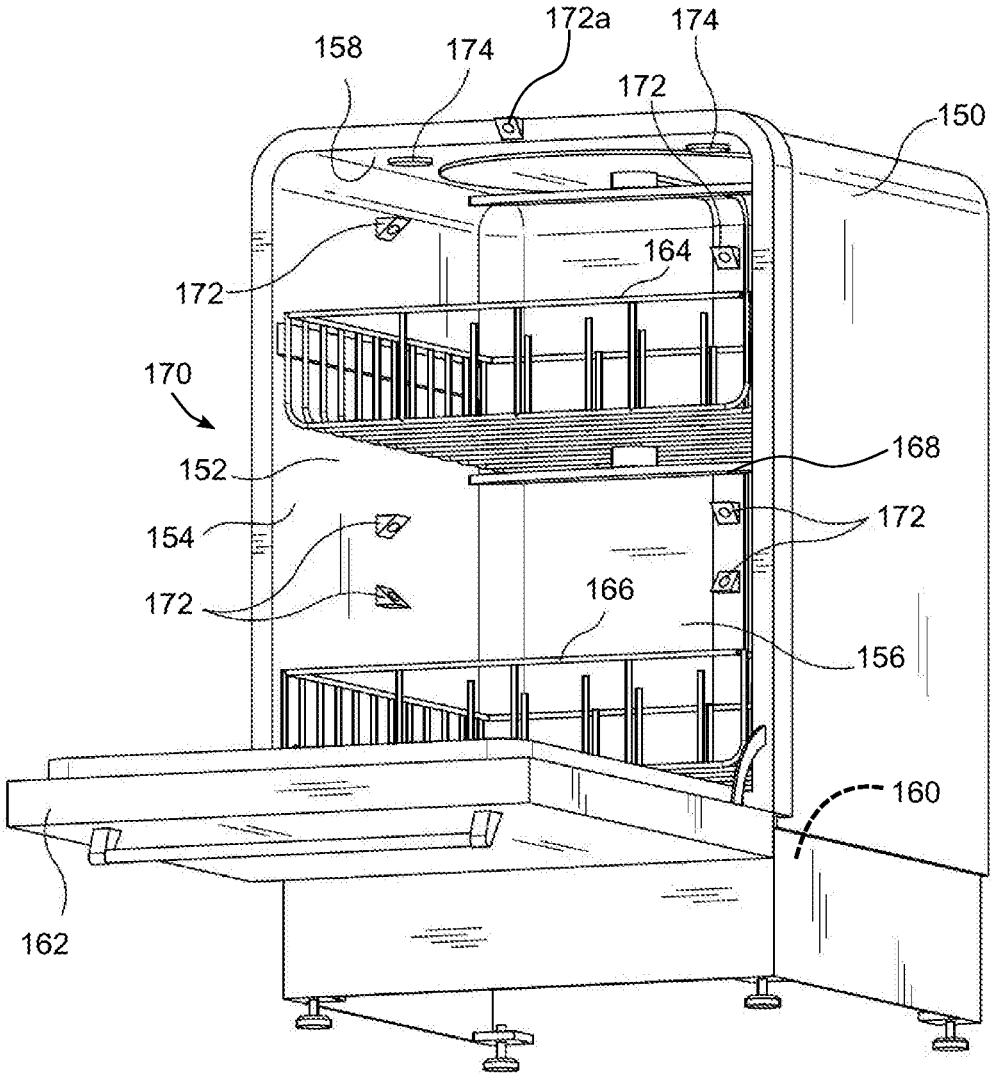
FIG. 5 is a perspective view of another dishwasher consistent with some embodiments of the invention, and incorporating an imaging system having multiple fixed cameras.

Now turning to FIG. 5, as noted above, a dishwasher consistent with the invention may also include an imaging system including one or more cameras or other imaging devices. FIG. 5, for example, illustrates an example dishwasher 150 including a wash tub 152 having side walls 154, a rear wall 156, a top wall 158 and a sump 160, a hinged door 162 providing access to the wash tub, and one or more racks, e.g., upper and lower racks 164, 166. While in some embodiments, tubular spray elements may be used to spray wash fluid throughout wash tub 152, in the embodiment illustrated in FIG. 5, one or more rotatable spray arms, e.g., spray arm 168 mounted to upper rack 164, may be used in lieu of or in addition to tubular spray elements.

An imaging system 170, including, for example, one or more cameras 172, may be used to collect image data within wash tub 152 for a variety of purposes. As noted above, cameras 172 may operate in the visible spectrum (e.g., RGB cameras) in some embodiments, or may operate in other spectra, e.g., the infrared spectrum (e.g., IR cameras), the ultraviolet spectrum, etc. Moreover, cameras 172 may collect two dimensional and/or three dimensional image data in different embodiments, may use range or distance sensing (e.g., using LIDAR), and may generate static images and/or video clips in various embodiments. Cameras may be disposed at various locations within a wash tub, including, for example, on any of walls 154, 156, 158, in corners between walls, on components mounted to walls (e.g., fluid supply conduits), in sump 160, on door 162, on any of racks 164, 166, or even on a spray arm 168, tubular spray element, or other movable component within a dishwasher. Moreover, different types of imaging devices may be used at different locations, or multiple imaging device of different types may be used at the same location (e.g., RGB in one location and IR in another, or RGB and IR in the same location). In addition, an imaging system 170 may also in some embodiments include one or more lights or other illumination devices 174 suitable for illuminating the wash tub to facilitate image collection. Illumination devices 174 may illuminate light in various spectra, including white light, infrared light, ultraviolet light, or even colored light in a particular segment of the visible spectra, e.g. a green, blue, or red light, or patterns of light (e.g., lines, grids, moving shapes, etc.), as may be desirable for particular applications, such as 3D applications. In addition, as illustrated by camera 172*a*, a camera may also capture image data outside of a wash tub, e.g., to capture images of a rack that has been extended to a loading position.

As noted above, and as is illustrated by cameras 172 and 172*a*, cameras may be fixed in some embodiments, and it may be desirable to utilize multiple cameras to ensure suitable coverage of all areas of a washtub for which it is desirable to collect image data. In other embodiments only a single camera may be used, and in addition, in some embodiments one or multiple cameras may be disposed on a movable component of a dishwasher to vary the viewpoint of the camera to capture different areas or perspectives within a dishwasher.

Figure 6:
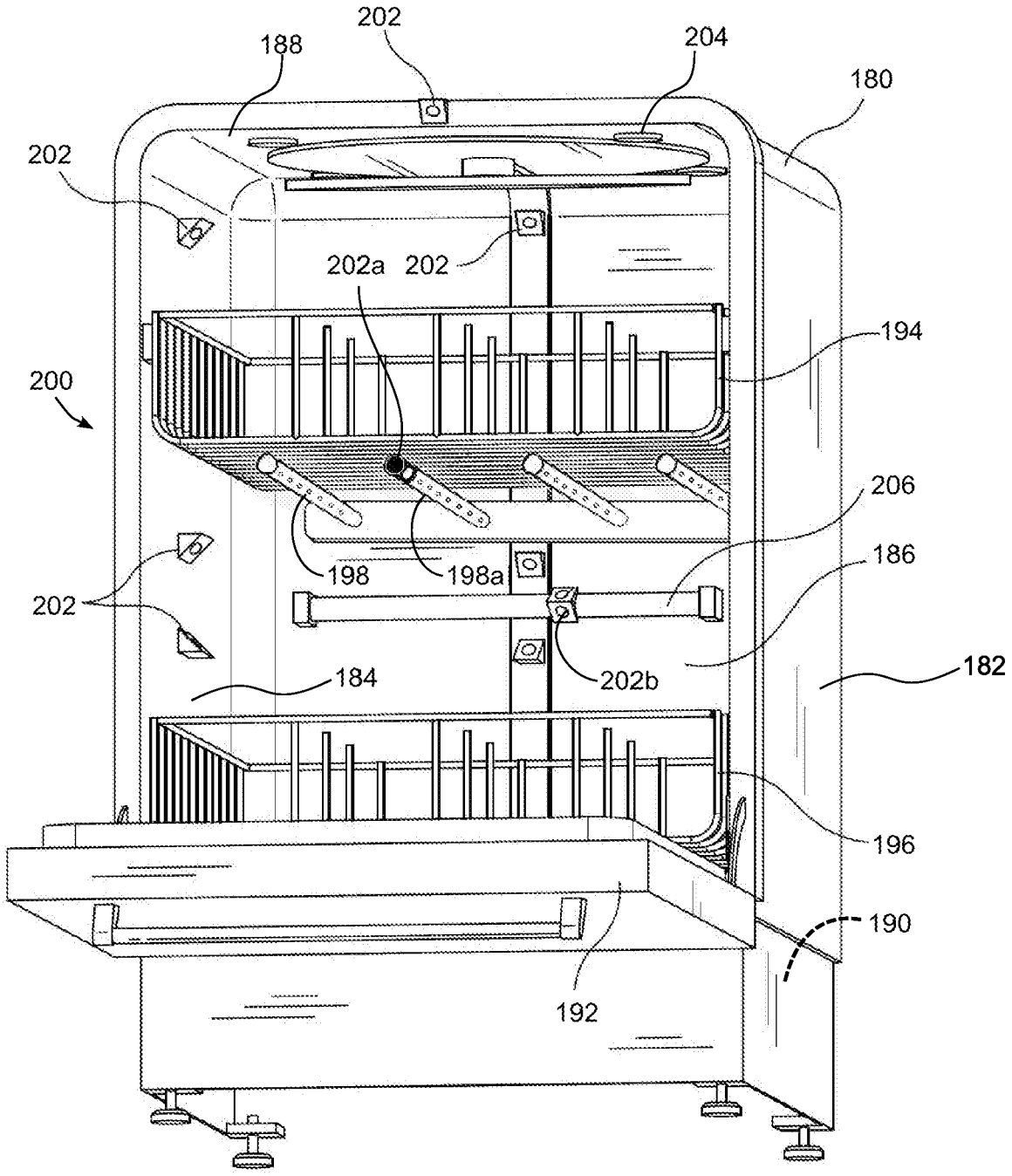
FIG. 6 is a perspective view of yet another dishwasher consistent with some embodiments of the invention, and incorporating an imaging system having multiple fixed and movable cameras.

FIG. 6, for example, illustrates an example dishwasher 180 including a wash tub 182 having side walls 184, a rear wall 186, a top wall 188 and a sump 190, a hinged door 192 providing access to the wash tub, and one or more racks, e.g., upper and lower racks 194, 196. In addition, in this embodiment, a plurality of tubular spray elements 198 are used to spray wash fluid throughout wash tub 182. An imaging system 200, including, for example, one or more cameras 202, may be used to collect image data within wash tub 182 for a variety of purposes, and one or more illumination devices 204 may also be disposed in the dishwasher for illumination purposes. As noted above, however, while some of cameras 202 may be fixed, others may be mounted on movable components. For example, a camera 202*a* is illustrated disposed on a spray device such as tubular spray element 198*a*, and it will be appreciated that the field of view of the camera may be controlled by a tubular spray element drive. As another example, camera 202*b* is illustrates as being disposed on a movable gantry 206, which permits horizontal and/or vertical movement of the camera. It will be appreciated that a camera may be movable and/or translatable in any number of directions and/or axes in different embodiments based upon the desired application of such camera, so the invention is not limited to the specific arrangement of cameras disclosed herein.

Tubular Spray Element Position Detection

As noted above, it may be desirable in some embodiments to additionally incorporate one or more position sensors to determine the position of a tubular spray element or other sprayer in a dishwasher. Position sensor 122 of FIG. 4, for example, is an encoder or hall sensor; however, in other embodiments, it may be desirable to utilize other position sensor implementations. It will be appreciated that due to the discrete control of a spray pattern available when utilizing tubular spray elements and other types of controllable sprayers, an ability to control and sense the trajectory of washing fluid within a dishwasher is desirable in many embodiments, as doing so may improve the effectiveness of a wash cycle, reduce cycle times, and facilitate the performance of additional operations that have heretofore not been possible in conventional dishwasher designs.

Figure 7:
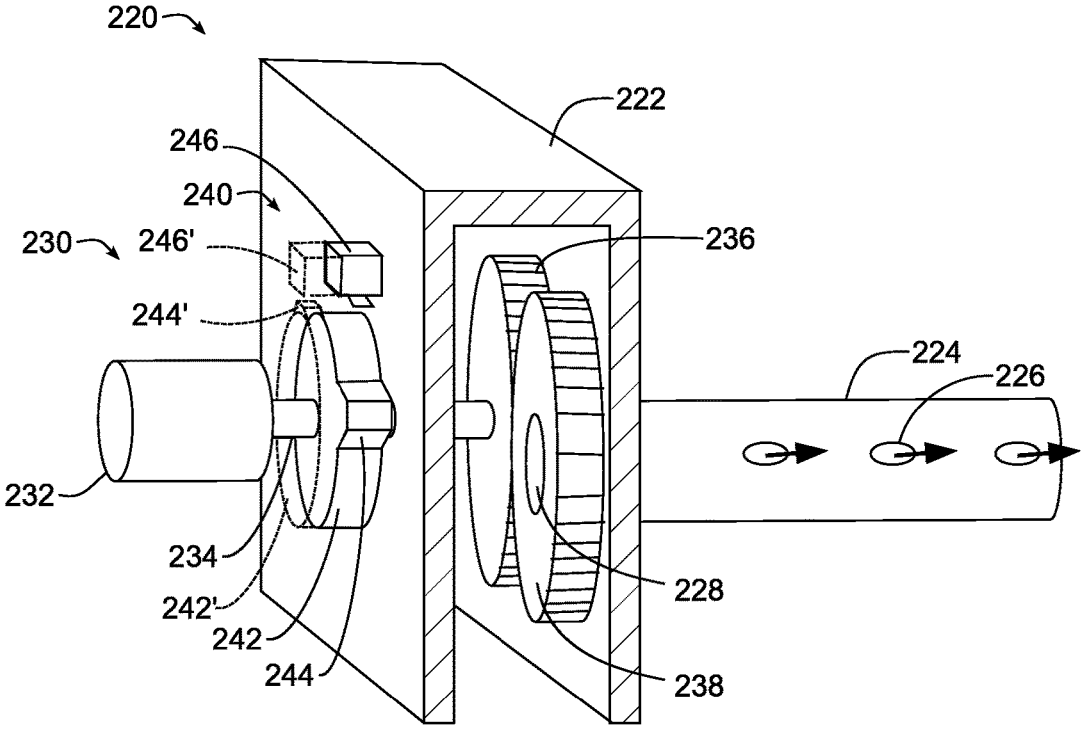
FIG. 7 is a partial cross-sectional view of a tubular spray element and tubular spray element drive incorporating a cam-based position sensor consistent with the invention.
Figure 8:
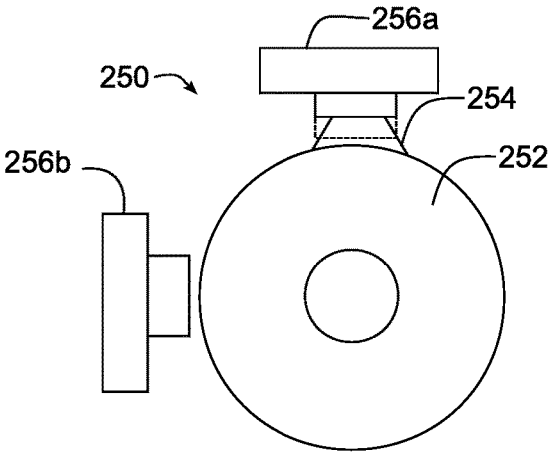
FIG. 8 is a functional end view of an alternative cam-based position sensor to that illustrated in FIG. 7, and incorporating multiple cam detectors.
Figure 9:
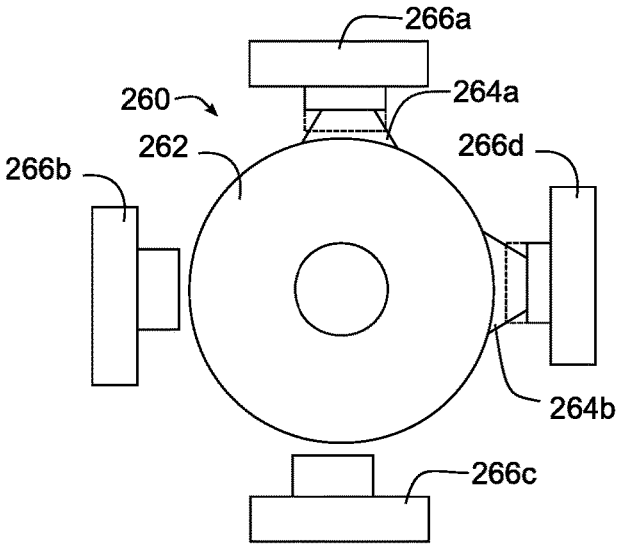
FIG. 9 is a functional end view of another alternative cam-based position sensor to that illustrated in FIG. 7, and incorporating multiple cam detectors and a cam with multiple lobes.

FIGS. 7-9, for example, discloses various cam-based position sensor implementations whereby one or more cams that rotate in connection with rotation of a tubular spray element may be sensed by one or more cam detectors to determine a current rotational position of a tubular spray element. In some embodiments, for example, a cam-based position sensor may be configured to sense multiple rotational positions among a plurality of rotational positions to which a tubular spray element drive may rotate an associated tubular spray element, and may include one or more cam detectors and a plurality of cam lobes operably coupled to the tubular spray element to rotate therewith.

FIG. 7, for example, illustrates a portion of a dishwasher 220 where a manifold 222 configured to be mounted on a side or rear wall of dishwasher 220 (not shown in FIG. 7) supports a tubular spray element 224 having one or more nozzles 226 configured to spray in a predetermined direction represented by the arrows in FIG. 7. Manifold 222 is in a fluid communication with a fluid supply (not shown) to convey fluid to tubular spray element 224 through an inlet port 228, and it will be appreciated that tubular spray element 224 is rotatably mounted to manifold 222 but is generally not removable therefrom. It will be appreciated however that the techniques described herein may also be used in connection with a dockable tubular spray element that is removable from a docking arrangement, e.g., where a tubular spray element is rack-mounted.

A tubular spray element drive 230 includes a motor 232, drive shaft 234 that projects through the wall of manifold 222 and a drive gear 236 that engages with a gear 238 that rotates with tubular spray element 224, such that rotation of drive shaft 234 by motor 232 rotates tubular spray element 224 through the engagement of gears 236, 238. While gears 236, 238 are illustrated as being within manifold 222, in other embodiments, the gears may be external from manifold 222, e.g., on the same side as motor 232, or alternatively, within the wash tub and on the same side as tubular spray element 224.

A cam-based position sensor 240 includes a cam 242 mounted to drive shaft 234 and including a cam lobe 244 defined at a rotational position relative to nozzles 226 of tubular spray element, e.g., at the same rotational position as nozzles 226 in some embodiments. A cam detector 246, e.g., a microswitch, is also positioned at a predetermined position about cam 242 and positioned within a path of travel of cam lobe 244 such that when cam 242 is rotated to a position whereby cam lobe 244 physically engages cam detector 246, a switch is closed and a signal is generated indicating that the tubular spray element 224 is at a predetermined rotational position. In the illustrated embodiment, for example, cam detector 246 is positioned at a top vertical position such that cam detector 246 generates a signal when nozzles 226 are directed straight upwards.

To simplify the discussion, it may be assumed that gears 236, 238 are identically configured such that tubular spray element 224 rotates a full revolution in response to rotation of drive shaft 234 by a full revolution, whereby the rotational position of tubular spray element 224 is derivable directly from the rotational position of drive shaft 234. In other embodiments, however, gears 236, 238 may be differently configured such that a full rotation of drive shaft 234 rotates tubular spray element by less than or more than a full revolution.

It will be appreciated that a cam detector in other embodiments may utilize other sensing technologies. For example, a cam detector may be implemented as a hall or magnetic sensor, and cam lobes on a cam may be implemented using magnets that are sensed by the hall or magnetic sensor when adjacent thereto. As another alternative, a cam detector may include one or more electrical contacts that close an electrical circuit when a cam lobe formed of metal or another electrical conductor engages the cam detector, or may include optical components that sense light or the blockage of light from different holes or durations.

Moreover, while position sensing is performed using a cam coupled to a drive shaft in the embodiment of FIG. 7 (such that the cam lobe(s) thereof rotate about an axis of rotation that is both coincident with the drive shaft and parallel to and offset from the longitudinal axis of the tubular spray element), in other embodiments, position sensing may be performed directly on tubular spray element 224 or a component that rotates therewith. FIG. 8, for example, illustrates an end view of a tubular spray element 250 including an integrated cam 252 including a single cam lobe 254, whereby cam lobe 254 rotates about an axis of rotation that is coincident with the longitudinal axis of tubular spray element 250.

FIG. 8 also illustrates another variation whereby multiple cam detectors, here cam detectors 256*a* and 256*b*, may be disposed around the perimeter of cam 252 to sense multiple rotational positions. Cam detectors may be placed at a multitude of rotational positions and for a multitude of purposes, e.g., to detect a "home" position, to detect rotational position corresponding to an "off" position for the tubular spray element (e.g., where an associated valve for the tubular spray element that is actuated through rotation of the tubular spray element is rotated to an off or closed position), to detect a deflector alignment position, to detect a "limit" position corresponding to a range limit (e.g., when it is desirable to define ranges where a tubular spray element should not be pointed, such as a wall of the wash tub), or to detect various "zones" in a dishwasher rack where it may be desirable to focus washing.

It will also be appreciated that a cam-based position sensor may include multiple cam lobes used with one or more cam detectors, and that these multiple cam lobes may rotate about a common axis and within a common plane (as is illustrated in FIG. 9), or alternatively, about a common axis and within different planes (as is illustrated in phantom in FIG. 7).

FIG. 9, for example, illustrates another variation whereby multiple cam lobes are disposed on a cam, and one or more cam detectors are used to sense the multiple cam lobes. In this implementation, a tubular spray element 260 includes a cam 262 integrated therewith and including multiple cam lobes 264*a*, 264*b* defined at different rotational positions. Moreover, while a single cam detector may be used in some embodiments, in the illustrated embodiment four cam detectors 266*a*, 266*b*, 266*c* and 266*d* are disposed at ninety degree increments around cam 262. It will be appreciated that in this implementation, four separate positions may be distinguished from one another based upon the combination of inputs from cam detectors 266*a-d*, since each ninety degrees of rotation will engage a different pair of cam detectors. Other numbers and positions of cam detectors and cam lobes may be used in other embodiments, so the invention is not limited to the particular implementations illustrated herein.

Returning to FIG. 7, it will also be appreciated that multiple cams may also be used in some embodiments, For example, a second cam 242' having a second cam lobe 244' and sensed by a second cam detector 246' are shown in phantom to support an ability to sense additional rotational positions. Second cam 242' rotates in a separate plane from cam 242, and thus a "stack" of two or more coaxial cams may be used in some embodiments to provide greater flexibility in terms of position sensing, particularly where discrimination between multiple distinct positions is desired.

Figure 10:
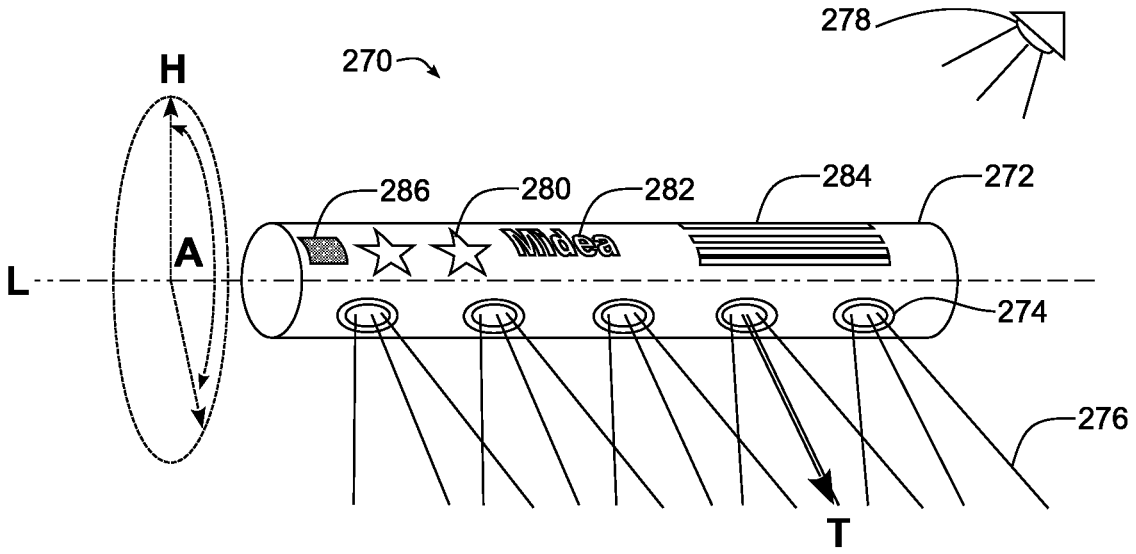
FIG. 10 is a functional perspective view of a tubular spray element and imaging system incorporating an image-based position sensor consistent with the invention.
Figure 11:
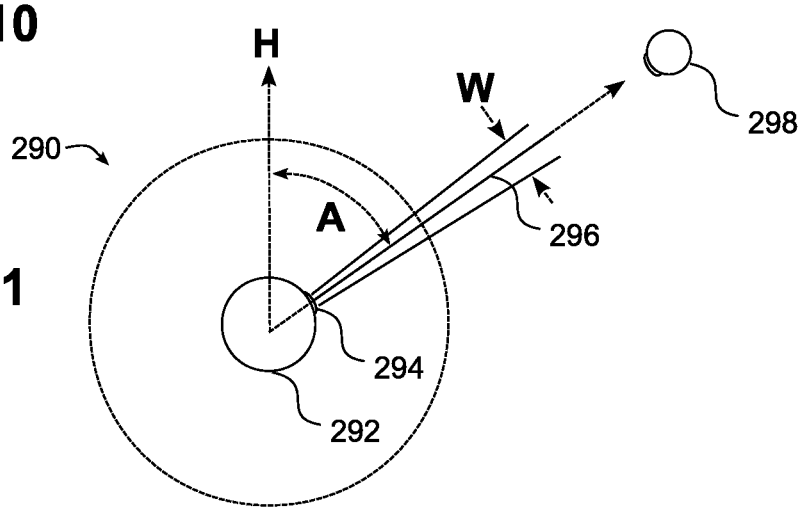
FIG. 11 is a functional end view of an alternative image-based position sensor to that illustrated in FIG. 10.
Figure 12:
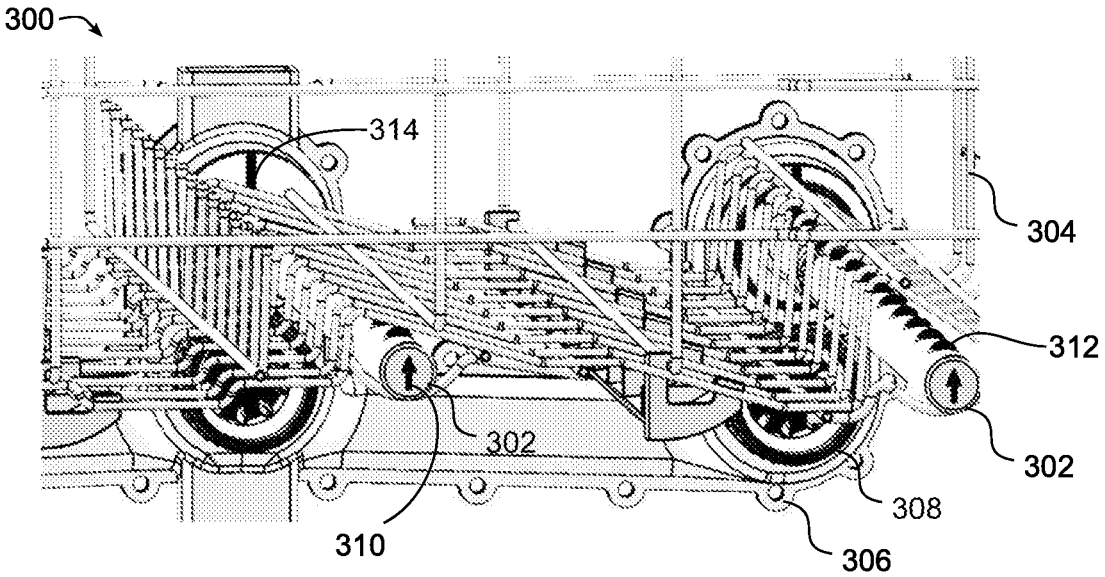
FIG. 12 is a perspective view of a dishwasher including a rack and a plurality of rack-mounted tubular spray elements incorporating distinctive features for use in image-based position sensing consistent with the invention.

Now turning to FIGS. 10-12, as an alternative to cam-based position sensing, image-based position sensing may be used in some embodiments of the invention, e.g., utilizing any of the various imaging system implementations described above. It will be appreciated, for example, that imaging systems may be utilized in dishwashers for other purposes, and as such, utilizing these imaging systems additionally to sense the rotational positions of tubular spray elements and/or other controllable sprayers in a dishwasher may be beneficial in some embodiments as doing so may reduce the number of sensors used to control tubular spray elements, lower costs and/or simplify a tubular spray element drive design.

FIG. 10, for example, illustrates an example dishwasher 270 including a tubular spray element 272 including a plurality of nozzles 274 that emit a spray pattern 276 generally along a trajectory T. A camera 278 or other imaging device may be positioned with tubular spray element 272 within its field of view to capture images of the tubular spray element during use. In some embodiments, multiple cameras 278 may be used to capture the tubular spray element from multiple viewpoints, while in other embodiments a single camera may be used.

A rotational position of tubular spray element 272 may be defined about its longitudinal axis L, and in some embodiments may be represented using an angle A relative to some home position H (e.g., a top vertical position in the illustrated embodiment, although the invention is not so limited).

The rotational position of tubular spray element 272 may be detected from image data based upon image analysis of one or more images captured from one or more image devices, and in many embodiments, may be based upon detecting one or more visually distinctive features that may be used to determine the current orientation of the tubular spray element about its longitudinal axis L. In some embodiments, for example, distinctive structures defined on the generally cylindrical surface of tubular spray element 272, e.g., nozzles 274, may be detected in order to determine the rotational position.

In other embodiments, however, distinctive indicia 280 that are incorporated into tubular spray element 272 solely or at least partially for purposes of image-based position sensing may be disposed at various rotational positions on the outer surface of tubular spray element 272. In addition, in some instances, as illustrated at 282, the distinctive indicia may be textual in nature. Furthermore, as illustrated at 284, the distinctive indicia may be designed to represent a range of rotational positions, such that image analysis of the indicia may be used to determine a specific rotational position within the range. Indicia 284, for example, includes a series of parallel bars that vary in width and/or spacing such that a location within the series of parallel bars that is visible in a portion of an image can be used to determine a particular rotational position, similar in many respects to the manner that a bar code may be used to retrieve numerical information irrespective of the orientation and/or size of the bar code in an image. Other indicia arrangements that facilitate discrimination of a rotational position out of a range of rotational positions may also be used in some embodiments, e.g., combinations of letters or numbers. In some embodiments, for example, an array of numbers, letters or other distinctive features may circumscribe the generally cylindrical surface of a tubular spray element such that a rotational position may be determined based upon the relative position of one or more elements in the array.

The indicia may be formed in varying manners in different embodiments, e.g., formed as recessed or raised features on a molded tubular spray element, formed using contrasting colors or patterns, integrally molded with the surface of the tubular spray element, applied or otherwise mounted to the surface of the tubular spray element using a different material (e.g., a label or sticker), or in other suitable manners. For example, a reflective window 286 may be used in some embodiments to reflect light within the washtub and thereby provide a high contrast feature for detection. Further, in some embodiments an indicia may itself generate light, e.g., using an LED. It will be appreciated that in some instances, fluid flow, detergent, and/or obstructions created by racks and/or utensils may complicate image-based position sensing, so high contrast indicia may be desirable in some instances to accommodate such challenging conditions.

With reference to FIG. 11, it will also be appreciated that image-based position sensing may also be based on sensing the actual fluid flow or spray pattern of fluid emitted by a tubular spray element. FIG. 11, in particular, illustrates a dishwasher 290 including a tubular spray element 292 with nozzles 294 that emit a spray pattern 296. Through appropriate positioning of a camera, an angle A relative to a home position H, and in some instances, a spray pattern width W, may be sensed via image-based position sensing. While a camera positioned to view generally along the longitudinal axis of the tubular spray element has a field of view well suited for this purpose, it will be appreciated that other camera positions may also be used.

In addition, in some embodiments, image-based position sensing may also be based upon the relationship of a spray pattern to a target, e.g., the example target 298 illustrated in FIG. 11, which may be, for example, disposed on a rack, on a tub wall, or another structure inside a dishwasher and having one or more visually-identifiable indicia disposed thereon. As will become more apparent below, in some embodiments it may be desirable to utilize a target in order to calibrate a tubular spray element drive, e.g., by driving the tubular spray element 292 to an expected position at which the spray pattern 296 will hit the target 298, determining via image analysis whether the spray pattern 296 is indeed hitting the target, and if not, adjusting the position of the tubular spray element to hit the target and updating the tubular spray element drive control accordingly.

Now turning to FIG. 12, it will also be appreciated that indicia may also be positioned on other surfaces of a tubular spray element and/or on other components that move with the tubular spray elements. FIG. 12 in particular illustrates a dishwasher 300 including multiple tubular spray elements 302 supported by a rack 304 and engaged with a docking arrangement 306 disposed on a back wall of the dishwasher tub, and including one or more rotatable docking ports 308. In this embodiment, an indicia, e.g., an arrow 310, may be disposed on an end surface of a tubular spray element 302, and may be oriented such that the arrow tip may be aligned with the nozzles 312 of the tubular spray element (or any other rotational position of the tubular spray element), such that image analysis of the arrow indicia may be used to determine a rotational position of the tubular spray element. It will also be appreciated that other indicia that present visually distinct orientations throughout the rotation of the tubular spray element may be used as an alternative to an arrow indicia.

In addition, nozzles 312 are illustrated in a contrasting color that may also be used to determine the rotational position. Furthermore, each tubular spray element 302 is illustrated with an indicia (a contrasting line) 314 disposed on a docking component of the tubular spray element, which may also be used in image-based position sensing in some embodiments. Other components, e.g., gears, or rotatable components of a docking arrangement, may also include distinct indicia to facilitate position sensing in other embodiments. Furthermore, multiple colors may be used at different locations about the circumference of a tubular spray element to facilitate sensing in some embodiments.

Figure 13:
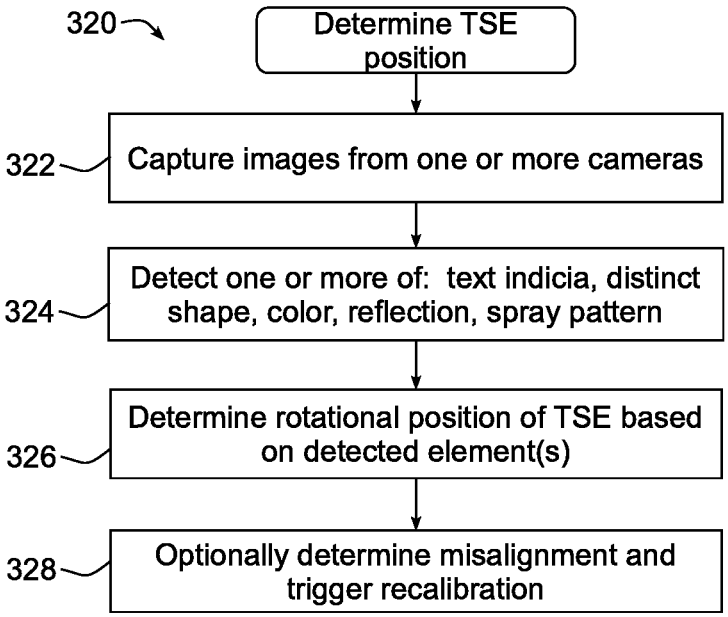
FIG. 13 is a flowchart illustrating an example sequence of operations for determining a rotational position of a tubular spray element during a wash cycle using an image-based position sensor consistent with the invention.

An example process for performing image-based position sensing consistent with the invention is illustrated at 320 in FIG. 13. In order to determine rotational position, one or more images may be captured from one or more cameras having fields of view that encompass at least a portion of the tubular spray element in block 322, and any of the aforementioned types of visually distinctive features (indicia, shapes, text, colors, reflections, spray patterns) may be detected in the image(s) in block 324. The rotational position is then determined in block 326 based upon the detected elements.

It will be appreciated that a rotational position may be determined from the detected elements in a number of manners consistent with the invention. For example, various image filtering, processing, and analysis techniques may be used in some embodiments. Further, machine learning models may be constructed and trained to identify the rotational position of a tubular spray element based upon captured image data. A machine learning model may be used, for example, to determine the position of a visually distinctive feature in block 324, to determine the rotational position given the position of a visually distinctive feature in block 326, or to perform both operations to effectively output a rotational position based upon input image data.

In addition, in some embodiments, it may be desirable to monitor for misalignments of a tubular spray element to trigger a recalibration operation. In block 328, for example, if it is known that the position to which the tubular spray element is being driven differs from the sensed position, a recalibration operation may be signaled such that, during an idle time (either during or after a wash cycle) the tubular spray element is recalibrated. In some embodiments, for example, image analysis may be performed to detect when a spray pattern is not hitting an intended target when the tubular spray element is driven to a position where it is expected that the target will be hit. In some embodiments, such analysis may also be used to detect when the spray pattern has deviated from a desired pattern, and recalibration of a flow rate may also be desired (discussed in greater detail below).

Figure 14:
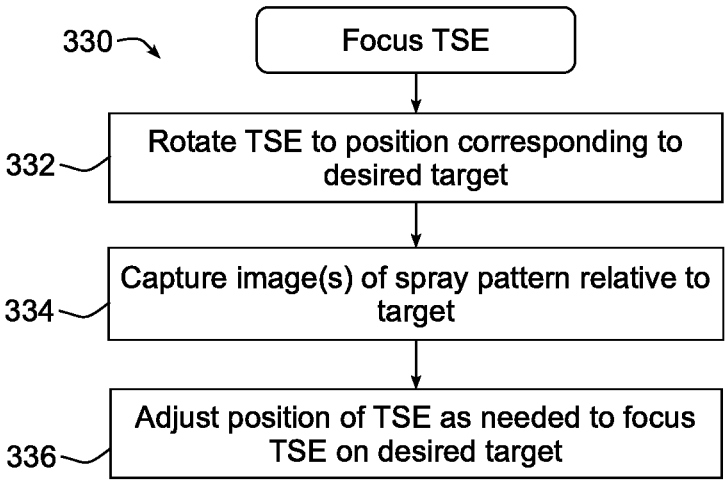
FIG. 14 is a flowchart illustrating an example sequence of operations for focusing a tubular spray element consistent with the invention.

Now turning to FIG. 14, it may also be desirable to use image-based position sensing to direct a tubular spray element to direct spray on a particular target, whereby a positional relationship between a spray pattern and a target may be used to control the rotational position of a tubular spray element. For example, as illustrated by process 330, a tubular spray element may be focused on a particular target by, in block 332, first rotating the tubular spray element to a position corresponding to a desired target, e.g., using process 320 to monitor TSE position until a desired position is reached. The target may be a particular component in the dishwasher, or a particular utensil in the dishwasher, or even a particular location on a component or utensil in the dishwasher (e.g., a particular spot of soil on a utensil). The target location may be determined, for example, based upon image analysis of one or more images captured in the dishwasher (from which, for example, a desired angle of spray is determined from the previously known position of a tubular spray element), or based upon a previously-known rotational position corresponding to a particular target (e.g., where it is known that the silverware basket is between 120 and 135 degrees from the home position of a particular tubular spray element).

Next, once the tubular spray element is rotated to the desired position, one or more images are captured in block 334 while a spray pattern is directed on the target, and image analysis is performed to determine whether the spray pattern is hitting the desired target. If so, no adjustment is needed. If not, however, block 336 may adjust the position of the tubular spray element as needed to focus the tubular spray element on the desired target, which may include continuing to capture and analyze images as the tubular spray element is adjusted.

While image-based position sensing may be used in some embodiments to detect a current position of a tubular spray element in all orientations, in other embodiments it may be desirable to use image-based position sensing to detect only a subset of possible rotational positions, e.g., as little as a single "home" position. Likewise, as noted above, cam-based position sensing generally is used to detect only a subset of possible rotational positions of a tubular spray element. In such instances, it may therefore be desirable to utilize a time-based control where, given a known rate of rotation for a tubular spray element, a tubular spray element drive may drive a tubular spray element to different rotational positions by operating the tubular spray element drive for a predetermined amount of time associated with those positions (e.g., with a rate of 20 degrees of rotation per second, rotation from a home position at 0 degrees to a position 60 degrees offset from the home position would require activation of the drive for 3 seconds). Given a rotation rate of a tubular spray element drive (e.g., in terms of Y degrees per second) and a desired rotational displacement X from a known rotational position sensed by a position sensor, the time T to drive the tubular spray element drive after sensing a known rotational position is generally $T=X/Y$.

Figure 15:
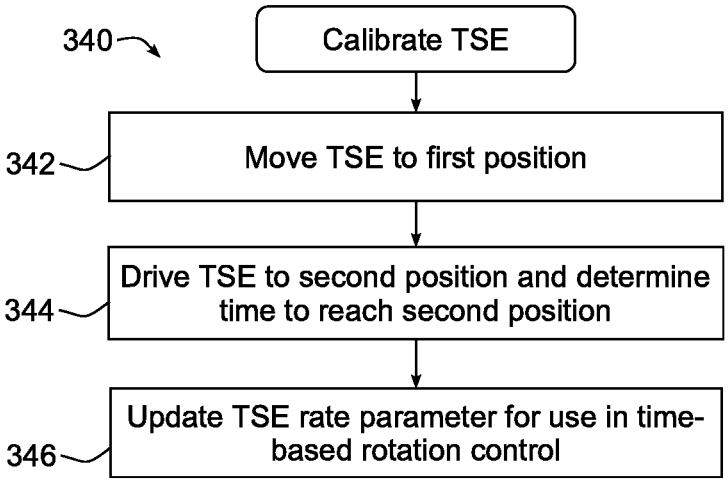
FIG. 15 is a flowchart illustrating an example sequence of operations for calibrating a tubular spray element consistent with the invention.

In order to determine the rotation rate of a tubular spray element, a calibration process, e.g., as illustrated at 340 in FIG. 15, may be used. It will be appreciated that calibration may be performed during idle times or during various points in a wash cycle, and may be performed in some instances while fluid is being expelled by a tubular spray element, or in other instances while no flow of fluid is provided to the tubular spray element. In addition, in some embodiments, different tubular spray elements may be calibrated at different times, while in other embodiments calibration may be performed concurrently for multiple tubular spray elements. It will also be appreciated that, in some instances, wear over time may cause variances in the rate of rotation of a tubular spray element in response to a given control input to a tubular spray element drive, and as such, it may be desirable to periodically perform process 340 over the life of a dishwasher to update the rotation rate associated with a tubular spray element.

In process 340, a tubular spray element is driven to a first position (e.g., a home position as sensed by an image-based position sensor or corresponding to a particular cam detector/cam lobe combination of a cam-based position sensor) in block 342, and then is driven to a second position in block 344, with the time to reach the second position determined, e.g., based upon a timer started when movement to the second position is initiated. The second position may be at a known rotational position relative to the first position, such that the actual rotational offset between the two positions may be used to derive a rate by dividing the rotational offset by the time to rotate from the first to the second position. The rate may then be updated in block 346 for use in subsequent time-based rotation control.

In some embodiments, the first and second positions may be separated by a portion of a revolution, while in some embodiments, the first and second positions may both be the same rotational position (e.g., a home position), such that the rotational offset corresponds to a full rotation of the tubular spray element. In addition, multiple iterations may be performed in some embodiments with the times to perform the various iterations averaged to generate the updated rate.

Figure 16:
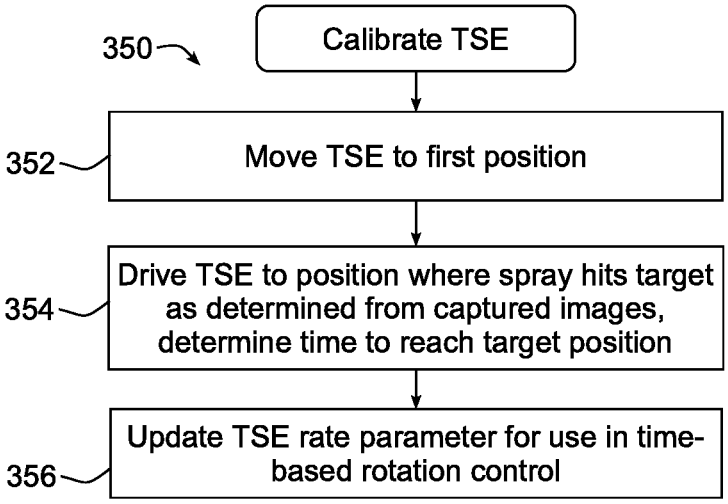
FIG. 16 is a flowchart illustrating another example sequence of operations for calibrating a tubular spray element.

As an alternative to process 340, calibration of a tubular spray element may be based upon hitting a target, as illustrated by process 350 of FIG. 16. In this process, the tubular spray element is driven to a known first position, e.g., a home position, in block 352. Then, in block 354, the tubular spray element is driven while wash fluid is expelled by the tubular spray element until the spray pattern is detected hitting a particular target, e.g., similar to the manner discussed above in connection with FIG. 14. During this time, the amount of time required to rotate from the first position to the target position is tracked, and further based upon the known rotational offset of the target position from the first position, an updated rate parameter may be generated in block 356 for use in subsequent time-based rotation control.

Figure 17:
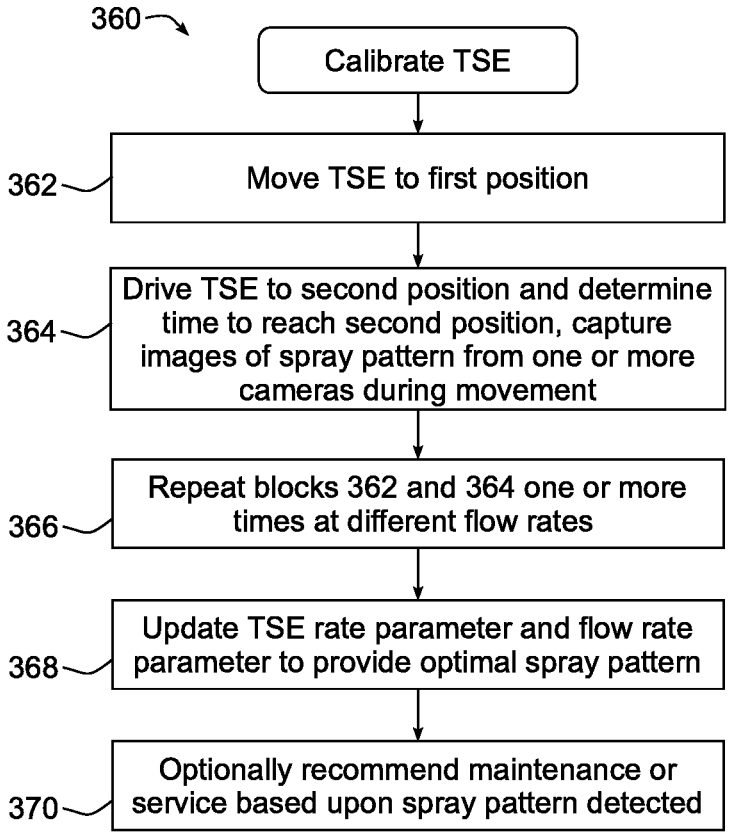
FIG. 17 is a flowchart illustrating yet another example sequence of operations for calibrating a tubular spray element, and incorporating image-based spray pattern analysis consistent with the invention.

FIG. 17 illustrates another example calibration process 360 suitable for use in some embodiments. Process 360, in addition to determining a rate of rotation, also may be used to assess a spray pattern of a tubular spray element and generate a flow rate parameter that may be used to control a variable valve that regulates flow through the tubular spray element, or alternatively control a flow rate for a fluid supply that supplies fluid to the tubular spray element. In particular, it will be appreciated that since solids build up over time with wash cycles (e.g., due to hard water and soils), it may be desirable to include a calibration mode where a dishwasher runs through a series of operations while visually detecting the rotational positions of the tubular spray elements. This collected information can serve a purpose of determining any degradation of rotational speed and/or change in exit pressure of wash liquid from the tubular spray elements over time. The calibration may then be used to cause a modification in rotational speed and/or exit pressure of water (e.g., via changes in flow rate) from the tubular spray elements in order to optimize a wash cycle.

Process 360 begins in block 362 by moving the tubular spray element to a first position. Block 364 then drives the tubular spray element to a second position and determines the time to reach the second position. In addition, during this time images are captured of the spray pattern generated by the tubular spray element. Next, in block 366, blocks 362 and 364 are repeated multiple times, with different flow rates supplied to the tubular spray element such that the spray patterns generated thereby may be captured for analysis. Block 368 then determines a rate parameter in the manner described above (optionally averaging together the rates from the multiple sweeps).

In addition, block 368 may select a flow rate parameter that provides a desired spray pattern. In some embodiments, for example, the spray patterns generated by different flow rates may be captured in different images collected during different sweeps, and the spray patterns may be compared against a desired spray pattern, with the spray pattern most closely matching the desired spray pattern being used to select the flow rate that generated the most closely matching spray pattern selected as the flow rate to be used. In addition, analysis of spray patterns may also be used to control rate of rotation, as it may be desirable in some embodiments to rotate tubular spray elements at slower speeds to increase the volume of fluid directed onto utensils and thereby compensate for reduced fluid flow. Further, in some embodiments, pressure strength may be measured through captured images. As one example, a tubular spray element may be rotated to an upwardly-facing direction and the height of the spray pattern generated may be sensed via captured images and used to determine a relative pressure strength of the tubular spray element.

In addition, as illustrated in block 370, it may be desired in some embodiments to optionally recommend maintenance or service based upon the detected spray patterns. For example, if no desirable spray patterns are detected, e.g., due to some nozzles being partially or fully blocked, it may be desirable to notify a customer of the condition, enabling the customer to either clean the nozzles, run a cleaning cycle with an appropriate cleaning solution to clean the nozzles, or schedule a service. The notification may be on a display of the dishwasher, on an app on the user's mobile device, via text or email, or in other suitable manners.

Figure 18:
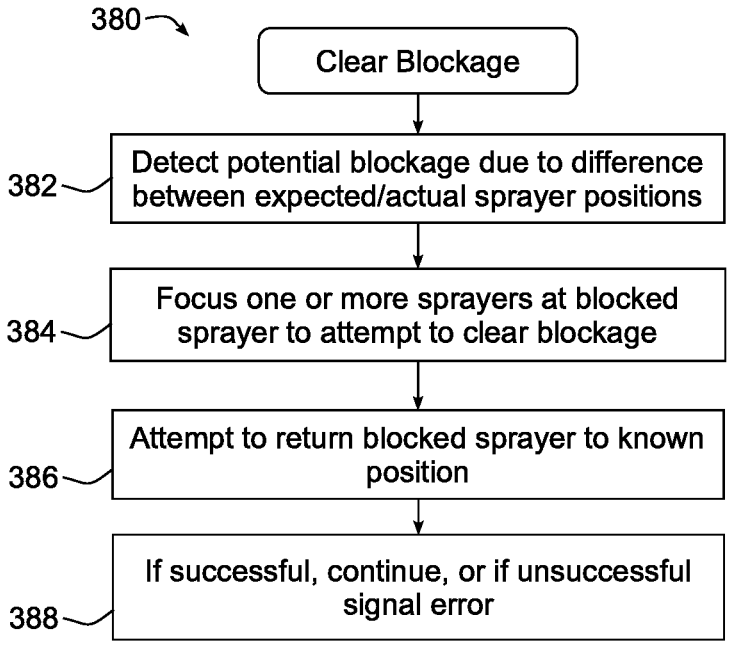
FIG. 18 is a flowchart illustrating an example sequence of operations for clearing a blockage in a sprayer consistent with the invention.

Now turning to FIG. 18, it may also be desirable in some embodiments to utilize position sensing to clear potential blockages in a tubular spray element. In a process 380, for example, a difference between sensed and expected rotational positions of a tubular spray element (or potentially of another type of controlled sprayer) may be detected in block 382, and may cause one or more tubular spray elements or other controlled sprayers to be focused on the blocked sprayers to attempt to clear the blockage. For example, if the gears or other drivetrain components for a controlled sprayer become blocked by food particles, other sprayers may be focused on the sprayer to attempt to clear the blockage.

After focusing spray on the blocked sprayer, block 386 may then attempt to return the blocked sprayer to a known position, and then monitor the position in any of the manners described above. Then, in block 388, if the movement is successful, the wash cycle may resume in a normal manner, and if not, an error may be signaled to the user, e.g., in any various manners mentioned above, for maintenance or service.

Object Sensing

In some embodiments of the invention, it may also be desirable to utilize an imaging system to evaluate the contents of a dishwasher prior to and/or during a wash cycle for the purposes of optimizing performance of the dishwasher. The imaging system may include one or more cameras or other imaging devices disposed within the dishwasher and capable of sensing one or more objects within the dishwasher. In some embodiments, the captured images may be two dimensional images, while in other embodiments, the captured images may be three dimensional in nature, and may be captured using distance or range information such that three-dimensional models of objects may be constructed.

Image analysis may then be performed to identify one or more objects within the dishwasher such that configuration determinations may be made based upon such identifications. Objects may include utensils placed in the dishwasher for washing, e.g., dishware, drinkware, silverware, pots, pans, baking sheets, baby bottles, pitchers, knives, tools. Objects may also include components or areas of a dishwasher, e.g., a rack, a sprayer, a basket (e.g., a silverware basket), a filter, a heating coil, an imaging device, a wall, a door, a dispenser, etc. Objects may also include detergent introduced into a dishwasher in some embodiments.

In some embodiments, objects may be identified only based upon a count, e.g., there are 17 objects in the rack. Objects may also be identified in some embodiments by a class, e.g., drinkware, silverware, dishware, etc., while in other embodiments, objects may be identified with greater particularity, e.g., a cup, a glass, a fork, or even with more detail, e.g., 12 oz ceramic cup, a 12 inch cast iron skillet, etc. Objects may be identified as having particular materials (e.g., glass, ceramic, metal), having particular sizes (e.g., 6 inches in diameter) and/or having particular durability ratings (e.g., delicate vs. robust) that characterize the objects' ability to withstand high pressure and/or temperature during washing.

Objects may also be associated with particular locations, e.g., whether they are in an upper or lower rack or in a silverware basket, or in some instances, with greater particularity as to location within a particular receptacle of the dishwasher, e.g., in zone 1 of 6 in the upper rack. In addition, object orientation may be determined in some embodiments, e.g., based upon patterns or shapes disposed on various surfaces of the objects, as doing so may be useful when focusing spray on the objects to ensure that the surfaces most likely to contain soil are washed (e.g., the tops of plates, the insides of cups, the interior of a pot or pan, etc.)

Object detection may be based, in some embodiments, on one or more images captured by one or more imaging devices of an imaging system. Image analysis in some embodiments may be based on detection of basic patterns, e.g., dishes are flat and circular, bowls are deeper, glasses are cylindrical, etc. In other embodiments, however, more sophisticated image analysis may be performed, e.g., using one or more machine learning models trained to detect various objects in a dishwasher and output object data such as type, size, location, material, etc. The analysis may also discriminate between objects that constitute part of the load of the dishwasher, e.g., utensils, and components of the dishwasher, e.g., racks, baskets, etc. It will be appreciated that training of machine learning models to implement such analysis would be within the abilities of those of ordinary skill having the benefit of the instant disclosure.

Figure 19:
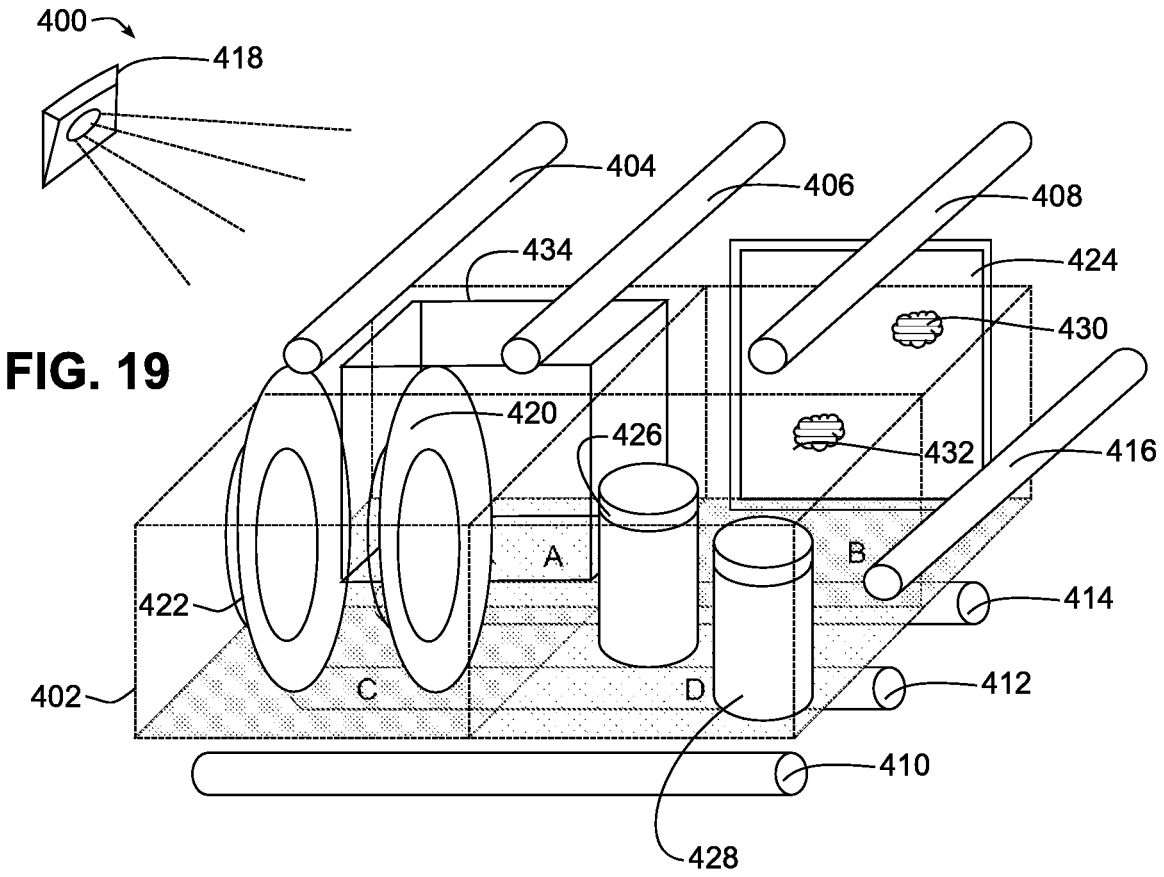
FIG. 19 is a functional perspective view of a dishwasher including image-based object sensing consistent with some embodiments of the invention.

Now turning to FIG. 19, this figure illustrates a portion of a dishwasher 400 including a rack 402 surrounded by a series of controllably-movable sprayers, here tubular spray elements 404-416. Tubular spray elements 404, 406 and 408 are disposed above rack 402, tubular spray elements 410, 412 and 414 are disposed below rack 402, and tubular spray element 416 is disposed to the side of rack 402, with tubular spray elements 410-414 running generally transverse to tubular spray elements 404-408 and 416. In addition, an imaging device 418 of an imaging system, here configured as a single wall-mounted and fixed camera, is used to capture images of rack 402. It will be appreciated that different numbers, locations, types and/or orientations of controllably-movable sprayers and/or imaging devices may be used in other embodiments, so the invention is not limited to the particular configuration illustrated in FIG. 19.

For the purposes of the subsequent discussion, rack 402 is illustrated housing a number of utensils 420-428, including two plates 420, 422, a baking sheet 424, and two glasses 426, 428. Moreover, baking sheet 424 is illustrated as including a pair of spots 430, 432 representing soil present on the baking sheet prior to the wash cycle. It will also be appreciated that rack 402 may include additional structures, e.g., a silverware basket 434, within which silverware, knives and other cooking implements may be placed for washing.

In some embodiments, it may be desirable to define multiple zones in a dishwasher, including multiple zones within each rack, such that customized washing may be performed in each zone. Rack 402, for example, is illustrated as having four zones A-D, with silverware basket 434 located in zone A, baking sheet 424 located in zone B, plates 420, 422 located in zone C and glasses 426, 428 located in zone D.

Figure 20:
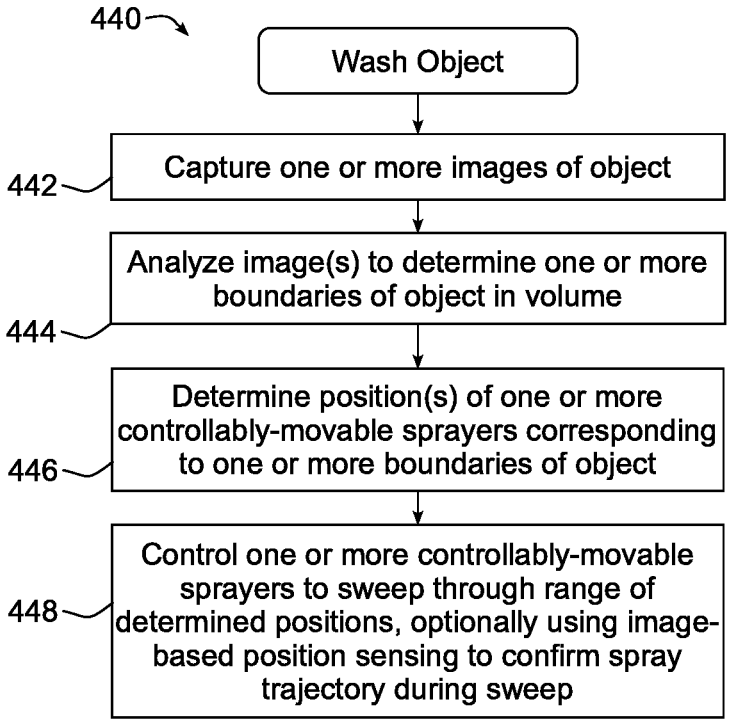
FIG. 20 is a flowchart illustrating an example sequence of operations for performing an object wash operation using the dishwasher of FIG. 19.

Now turning to FIG. 20, this figure illustrates a process 440 for washing an object consistent with some embodiments of the invention. In particular, due to the precision by which the various tubular spray element and other controllably-movable sprayer designs disclosed herein can direct fluid within a dishwasher, it may be desirable in some embodiments to focus on washing particular objects, rather than directing fluid in particular zones or areas of a dishwasher, or simply directing fluid indiscriminately throughout a dishwasher. Object washing may be used to wash each object in a dishwasher in some embodiments, although in many embodiments, object washing may be used only on particular objects that regularly warrant additional attention, e.g., objects detected as cooking containers such as pots, pans, baking sheets, etc., and leaving other objects to be washed using less focused sprays. Object washing may also be used in some embodiments to wash particular surfaces of such objects, e.g., to wash the interior portions of cooking containers, the top surfaces of plates or bowls, the interiors of drinkware, etc.

Object washing in particular may be based in part upon a calculation of a range of motion for one or more controllably-movable sprayers that is suitable for covering one or more surfaces of the object with fluid. For example, process 440 illustrates an example object washing operation that is based upon one or more images captured of the object (block 442) and analyzed to determine one or more boundaries of the object within a volume (block 444). Block 446 may then determine positions of one or more controllably-movable sprayers corresponding to the determined boundaries of the object, such that block 448 may control one or more controllably-movable sprayers to sweep through a range of determined positions corresponding to the boundaries. In addition, in some embodiments, the trajectory of the fluid itself may be used to verify the spray hitting its desired target, e.g., as discussed above in connection with FIG. 14. Further, while positions may correspond to the actual boundaries of objects in some embodiments, positions in other embodiments may include some variances between the boundaries, e.g., some percentage beyond each boundary.

Figure 21:
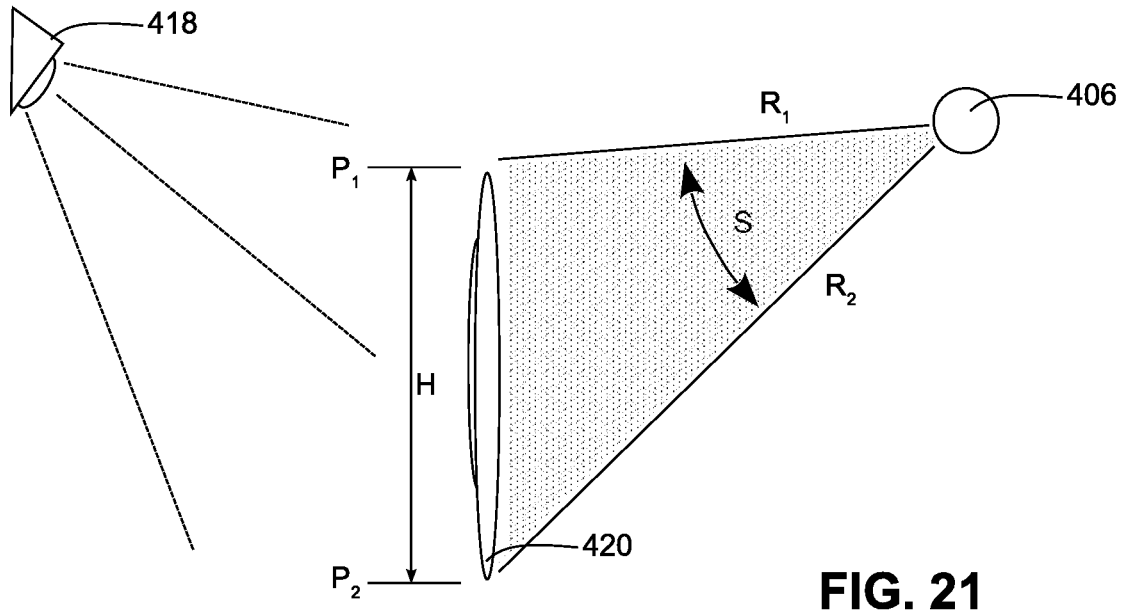
FIG. 21 is a functional side elevational view illustrating an example object sweep performed in the dishwasher of FIG. 19.

By way of example, FIG. 21 illustrates plate 420, which has a height H and which is imaged by imaging device 418 and analyzed to determine top and bottom boundaries $P_1$ and $P_2$. As discussed above in connection with FIG. 20, rotational positions $R_1$ and $R_2$ may be determined for tubular spray element 406 that correspond to the top and bottom boundaries $P_1$ and $P_2$. Thus, by sweeping tubular spray element 406 through the sweep S (which generally refers to the path of travel between the rotational positions) between rotational positions $R_1$ and $R_2$, plate 420 may be washed in an efficient manner that maximizes the amount of fluid that actually impinges on the plate. Moreover, in the event, for example, that plate 420 is disposed proximate a tub wall, focusing the wash of the plate in this manner minimizes the amount of fluid that is directed at the tub wall, and thus reduces the amount of noise that would otherwise be caused due to spraying the tub wall.

Process 440 may be used in connection with controlling one controllably-movable sprayer to wash one object in some embodiments, or may be used in other embodiments to control multiple controllably-movable sprayers and/or multiple objects (e.g., collections of closely positioned objects). Thus, determined boundaries may be based on collections of objects and determined positions of controllably-movable sprayers may be based upon coverage of those collections of objects in some embodiments.

Figure 22:
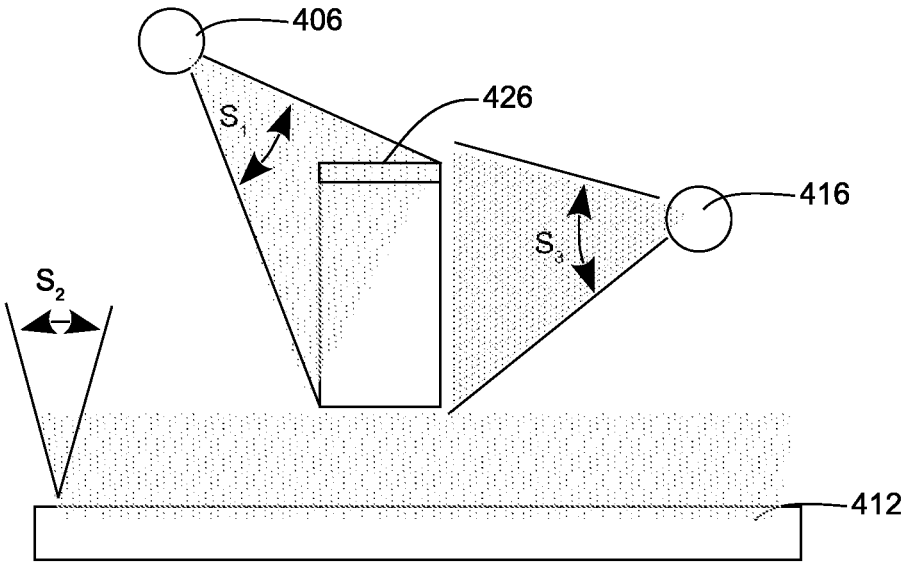
FIG. 22 is a functional side elevational view illustrating another example object sweep performed in the dishwasher of FIG. 19.

Furthermore, when multiple controllably-movable sprayers are directed to the same object, those sprayers may be disposed in the same or different planes and/or elevations, and may have different determined positions or sweeps based upon the relatively positions of those sprayers to the object in question. FIG. 22, for example, illustrates tubular spray elements 406, 412 and 416 spraying glass 426, and having individual determined sweeps $S_1$, $S_2$ and $S_3$ based upon the relative positions of the tubular spray elements to the glass.

In addition, where the object being washed is a component of the dishwasher itself, e.g., a silverware basket such as silverware basket 434 of FIG. 19, process 440 may be used to provide one or more focused sprays towards all of the utensils housed within the basket.

Figure 23:
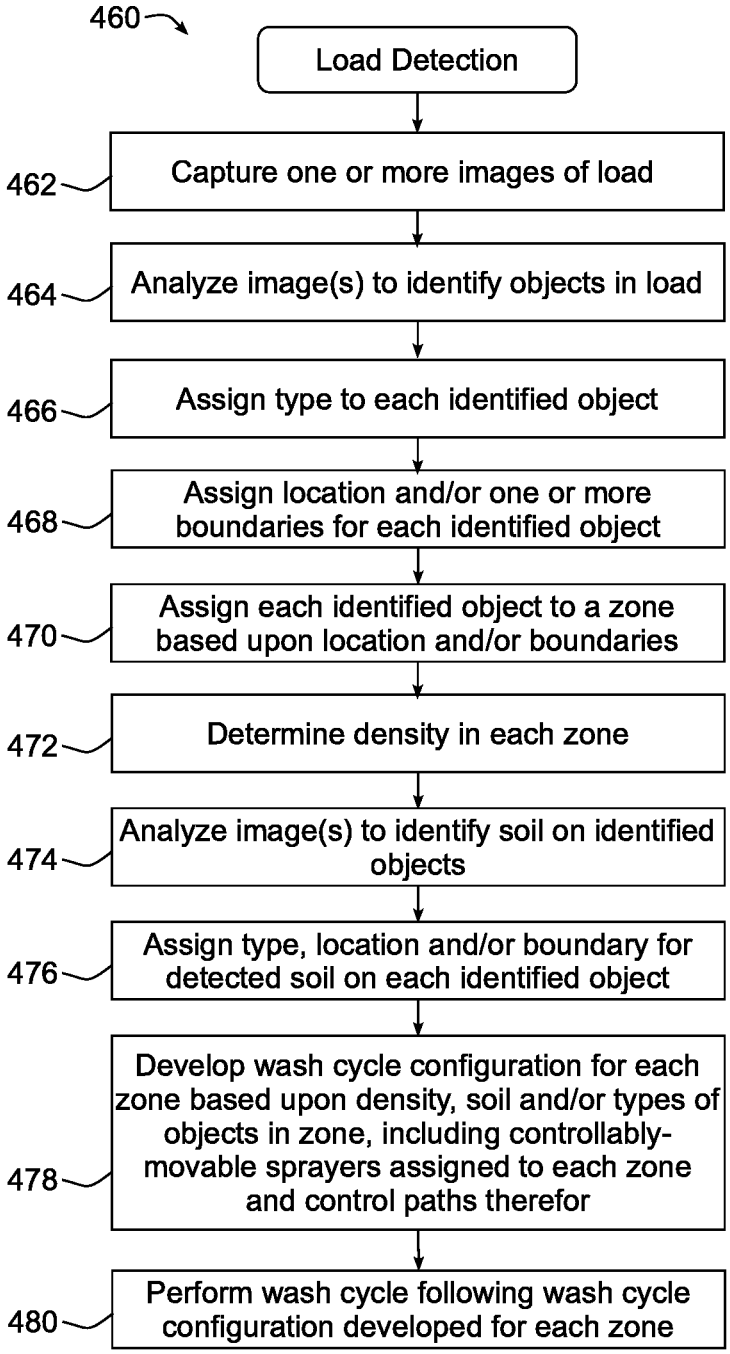
FIG. 23 is a flowchart illustrating an example sequence of operations for performing a load detection operation using the dishwasher of FIG. 19.

Object washing in some embodiments may be based on sensing individual objects, while in other embodiments, object washing may be utilized in connection with load detection, e.g., as illustrated by process 460 of FIG. 23. Load detection, in this regard, generally refers to an image-based detection and/or characterization of the various utensils loaded into the dishwasher and washed during a wash cycle. Load detection may be used to provide object information for use in object washing such as described above, but may also be used for other purposes in a dishwasher, e.g., to customize the wash cycle configuration for different objects, regions, and/or zones in a dishwasher.

As illustrated in FIG. 23, for example, one or more images may be captured of a load in block 462, e.g., during loading of the dishwasher, after the door of the dishwasher is closed, immediately prior to starting the wash cycle, or at various points during the wash cycle. The images may be captured from one or more perspectives, may be two or three dimensional in nature, and may be stitched together in some instances, and illumination within the wash tub may be used in some instances as well. In some embodiments, for example, images may be captured after every door close or detected rack movement. By doing so, multiple images may be combined to better determine the contents of a load, and further may minimize or otherwise mitigate image impingement of multiple items that may otherwise inhibit detection.

Block 464 next analyzes the images to identify the objects in the load, and then based upon the identified objects, various characteristics of the objects are identified. For example, as illustrated in block 466, a type, e.g., including a class, material, shape, size, durability, etc. may be assigned to each object based on the image analysis. In addition, as illustrated in block 468, a location and/or one or more boundaries may be assigned to each object based on the image analysis.

Next, in block 470, each object may be assigned to a particular zone based upon its location and/or boundaries. In some embodiments, for example, different regions of different racks may be associated with different zones, such that objects within those zones are washed collectively using a particular configuration or customization specific to that zone (including no washing in the event that a particular zone is empty). Different numbers and layouts of zones may be used in different embodiments, thereby varying the degree of customization that is utilized for a particular dishwasher.

Next, in block 472, a density may be determined for each zone, representing the number and/or relative size, surface area, or volume of the objects assigned to a zone. It will be appreciated that in many instances zones with greater density will generally benefit from additional attention during a wash cycle, so identifying a density of each zone may be used to configure wash settings such as the duration or percentage of time devoted to a particular zone.

Next, in block 474, it may also be desirable to analyze the captured images to attempt to identify specific spots of soil on certain objects, e.g., using machine learning models trained to identify particular spot features. If a particular pan, for example, has one or more spots with baked on food residue, it may be desirable to direct additional attention to that object, and in some instances, to the spot itself. Thus, for any identified spots of soil, block 476 in some embodiments may assign a type, e.g., a type of food, whether it is caused by cooking (e.g., if present on a cooking utensil), whether it appears caked-on or burnt, etc. Block 476 may also assign a location and/or a boundary for the spot of soil in some embodiments. In addition, in some embodiments some spots may be ignored, e.g., if they are determined to be too small, easily washable, or otherwise not sufficient to warrant specific attention during a wash cycle.

Next, in block 476, a wash cycle configuration may be determined for each zone based upon one or more of the density, soil and/or types of objects located in each zone. The configuration may include parameters such as wash temperatures, durations of operations, numbers of operations, spray patterns, and/or spray pressures in some embodiments. Moreover, a wash cycle configuration may also include specific control parameters for one or more controllably-movable sprayers, e.g., to which zones a particular controllably-movable sprayer is to be assigned at different points in a wash cycle, as well as the sweep, rate of rotation and/or rotational positions to be used at different points in a wash cycle, etc. (collectively referred to herein as control paths for the sprayer). Further, additional types of configurations may be based upon types of objects in a zone, e.g., metal cooking containers may warrant additional sprayers, added soak time, spray isolation to protect other objects, while glass objects such as glassware may warrant lower temperatures to prevent damage, lower pressure to prevent dislodgement, narrower spray patterns to focus on the interiors thereof.

Then, once the wash cycle configuration is determined, block 480 may perform the wash cycle, and in doing so, following the wash cycle configuration developed for each zone. it will be appreciated that some of the various characteristics of a load discussed above may not be determined or considered in the generation of a wash cycle configuration in some embodiments, and that other characteristics may also be determined or considered in other embodiments. Therefore, the invention is not limited to the particular combination of factors used in FIG. 23 to generate a wash cycle configuration.

Figure 24:
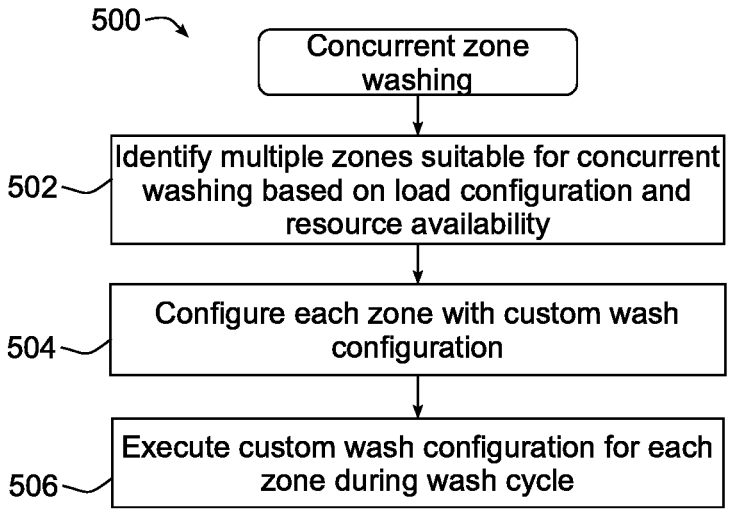
FIG. 24 is a flowchart illustrating an example sequence of operations for performing a concurrent zone washing operation using the dishwasher of FIG. 19.

Next, as illustrated in FIGS. 24-27, a number of specific operations may be implemented in some wash cycles based upon the load detection and/or wash cycle configuration discussed above, e.g., representing operations performed during blocks 478 and 480 of FIG. 23. FIG. 24, for example, illustrates a process 500 for performing a concurrent zone washing operation that may be used to configure multiple zones for concurrent washing. It will be appreciated that individually washing zones may be inefficient in some embodiments, and may unduly extend the duration of a wash cycle, so it may be desirable to wash multiple zones concurrently. On the other hand, a dishwasher may have limited resources, e.g., water pressure and heat generation, so in many instances all zones may not be washed at the same time. Further, due to incompatibilities between the demands of different zones, it may be desired to wash different zones at different times using different configurations optimized to those particular zones.

Thus, process 500 may begin in block 502 by identifying multiple zones suitable for concurrent washing based upon load configuration (e.g., the number and types of objects in each zone) and/or resource availability (e.g., the amount of water pressure and heat generation that may be devoted to the concurrent washing). When such zones are identified, block 504 may configure each zone with a custom wash configuration for that zone, and block 506 may execute that custom wash configuration for each zone during the wash cycle. The custom wash configurations may vary from one another based on factors such as fluid pressure, spray patterns, duration, numbers of assigned controllably-movable sprayers, control paths, etc.

Figure 25:
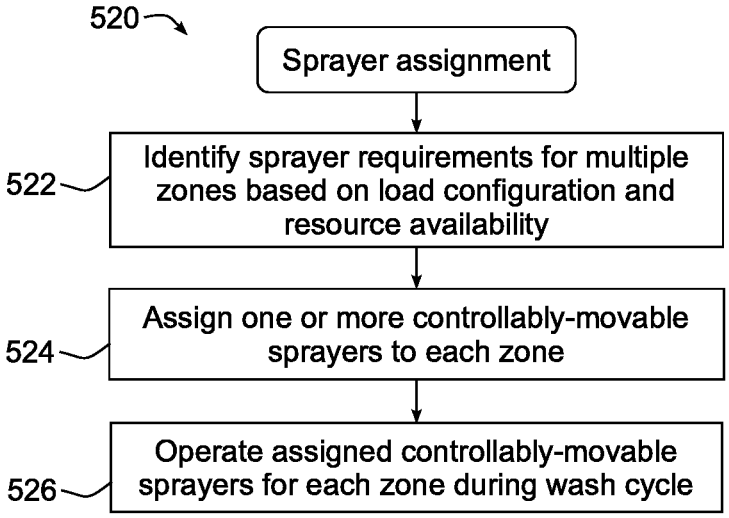
FIG. 25 is a flowchart illustrating an example sequence of operations for performing a sprayer assignment operation using the dishwasher of FIG. 19.

As illustrated by process 520 of FIG. 25, for example, another specific type of operation may be a sprayer assignment operation that assigns one or more controllably-movable sprayers that are capable of being used to wash multiple zones (hereinafter referred to as multi-zone controllably-movable sprayers) to a particular zone based upon load configuration and/or resource availability. As one example, with reference to dishwasher 400 of FIG. 19, for washing zones A and B, it may be desirable to assign tubular spray element 404 to zone A, assign tubular spray element 408 to zone B, and assign tubular spray element 406 to whichever of zone A or B is determined to benefit from additional attention.

Thus, returning to FIG. 25, process 520 may begin in block 522 by identifying sprayer requirements for multiple zones based upon load configuration (e.g., the number and types of objects in each zone) and/or resource availability (e.g., the amount of water pressure and heat generation that may be devoted to concurrent washing of different zones). When such sprayer requirements are identified, block 524 may assign one or more controllably-movable sprayers to each zone, and block 506 may operate those assigned sprayers for each zone during the wash cycle.

Figure 26:
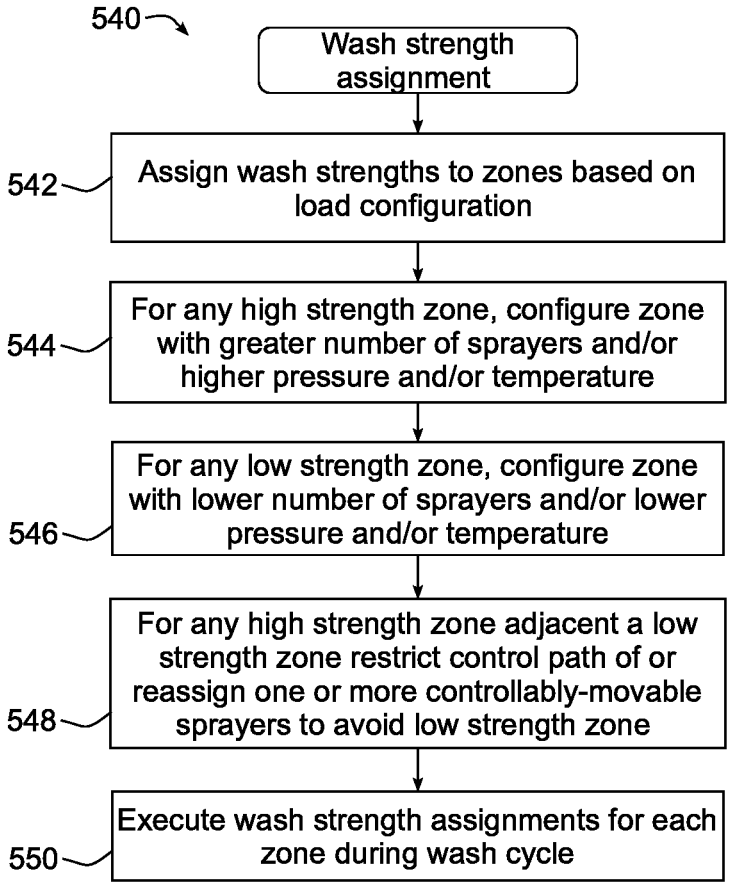
FIG. 26 is a flowchart illustrating an example sequence of operations for performing a wash strength assignment operation using the dishwasher of FIG. 19.

As illustrated by process 540 of FIG. 26, it may also be desirable to perform a wash strength assignment operation to vary the relative "strength" of washing in a particular zone. A wash strength, in general, may refer to the use of fluid pressure, temperature, different types of detergents (where dispensation of multiple detergents is supported), or other wash parameters that may be varied based upon how much a particular load (or portion of a load disposed in a zone), can be expected to withstand with low risk of damage. Metal pots and pans, for example, generally may be considered to be highly resistant to high wash strengths, whereas glassware and plastic objects (and particularly objects such as delicate wine glasses or plastic storage containers) may be at a risk of damage due to high temperatures or becoming dislodged from their locations and crashing into other objects due to high fluid pressure.

As such, process 540 may begin in block 542 by assigning different wash strengths to different zones based on load configuration (e.g., the number and types of objects in each zone). In block 544, for any zone assigned a high wash strength, the zone may be configured, for example, with a greater number of sprayers, a higher fluid pressure and/or a higher temperature. Conversely, in block 546, for any zone assigned a low wash strength, the zone may be configured, for example, with a lesser number of sprayers, a lower fluid pressure and/or a lower temperature.

Furthermore, as illustrated in block 548, potential harm to objects in adjacent zones may also be considered, whereby if a high strength zone is determined to be adjacent to a low strength zone, it may be desirable to restrict the control path of one or more controllably-movable sprayers and/or reassign one or more controllably-movable sprayers to another zone to specifically avoid negative impacts to the low strength zone. Block 550 may then execute those wash strength assignments for each zone during the wash cycle.

Figure 27:
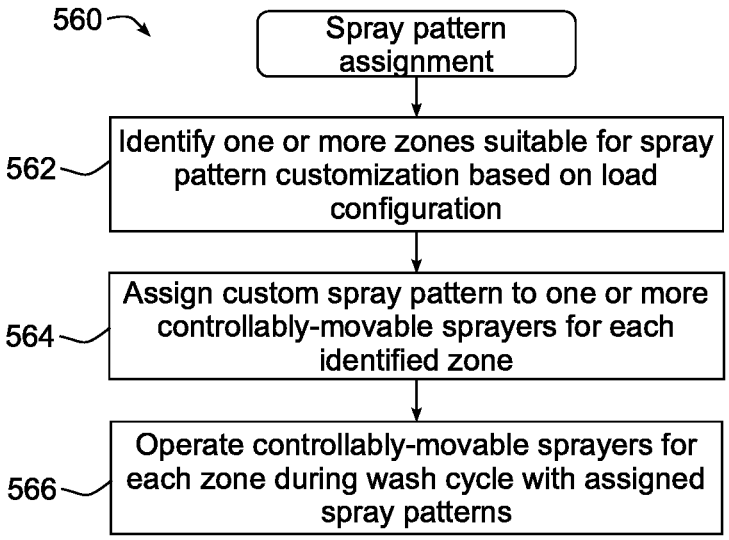
FIG. 27 is a flowchart illustrating an example sequence of operations for performing a spray pattern assignment operation using the dishwasher of FIG. 19.

Next, as illustrated by process 560 of FIG. 27, it may also be desirable to perform a spray pattern assignment to vary the spray patterns used in a particular zone. A spray pattern, in this regard, may be considered to refer to a profile of the fluid expelled from a particular controllably-movable sprayer. Some controllably-movable sprayers, for example, may have mechanically or electromechanically adjustable or switchable nozzles that can vary in terms of width of spray, exit velocity, flow rate, etc. Similarly, some controllably-movable sprayers may have nozzles that can vary based upon the fluid pressure supplied to the sprayers, e.g., varying between a narrow, focused stream or jet and a wide and distributed spray, shower, mist or fan.

As such, process 560 may begin in block 562 by identifying one or more zones suitable for spray pattern customization based upon load configuration (e.g., the number and types of objects in each zone). When such zones are identified, block 564 may assign a custom spray pattern to one or more controllably-movable sprayers for each identified zone, and block 566 may operate those sprayers accordingly for each zone during the wash cycle.

Figure 28:
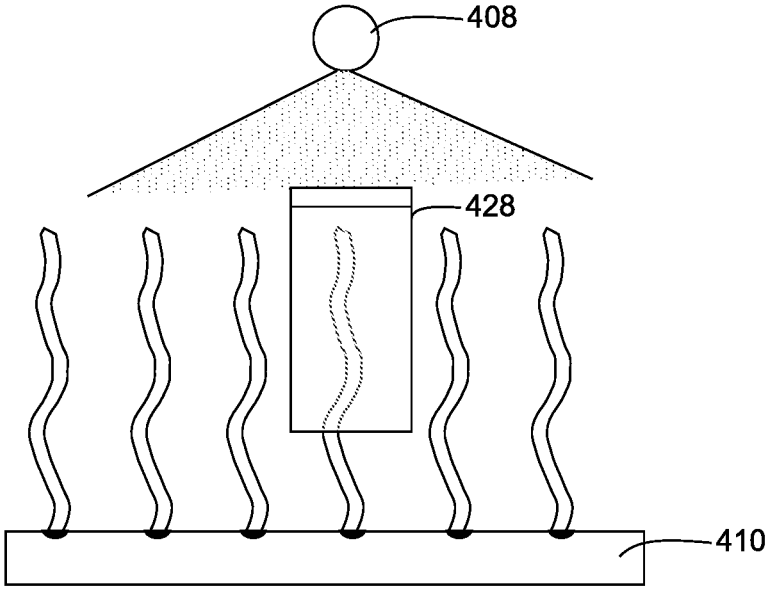
FIG. 28 is a functional side elevational view illustrating varying spray patterns used in the dishwasher of FIG. 19.

As but one example, FIG. 28 illustrates tubular spray elements 408 and 410 positioned proximate glass 428 illustrated in FIG. 19. In some embodiments, for example, it may be determined from process 560 that zone D, in which glass 428 is disposed, may benefit from spray pattern customization due to the presence of glasses in the zone. Thus, it may be desirable to configure tubular spray element 410 to spray in a narrow pattern that directs fluid into the interior of glass 428, while configuring tubular spray element 408 to have a wider, less directed pattern that flows fluid over the exterior of the glass without disturbing the glass and potentially knocking it over. Other situations that could benefit from varied spray patterns will be appreciated by those of ordinary skill having the benefit of the instant disclosure.

Figure 29:
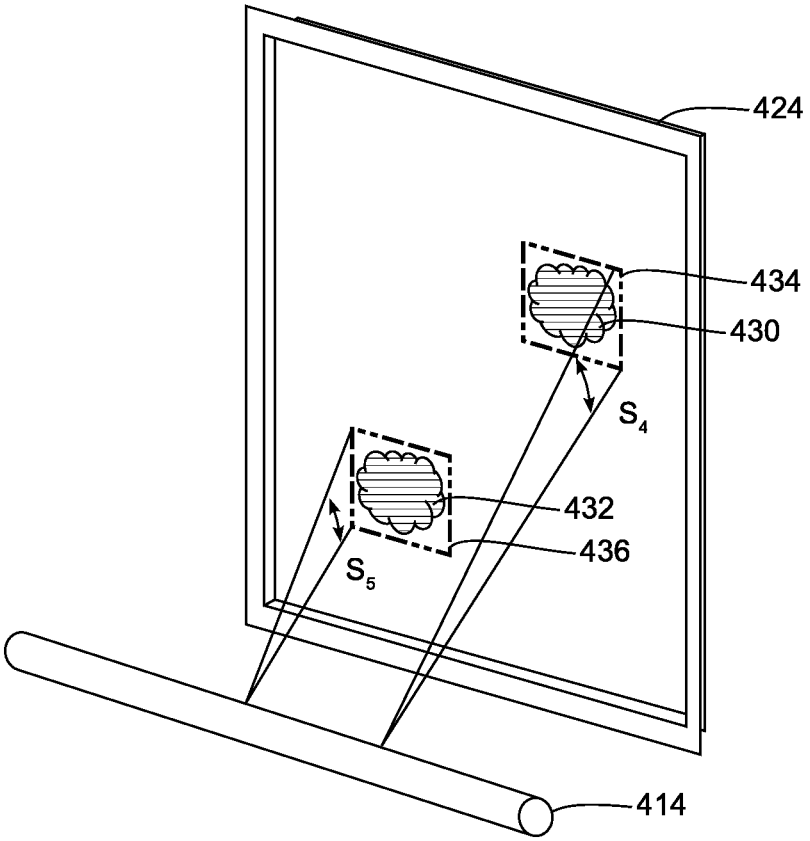
FIG. 29 is a functional perspective view illustrating spot spraying in the dishwasher of FIG. 19.

Now turning to FIG. 29, as noted above it may be desirable in some embodiments to focus washing efforts on particular spots on objects, rather than on the objects themselves or on zones or regions of a dishwasher. FIG. 29, in particular, illustrates baking pan 424 and tubular spray element 414 illustrated in FIG. 19, with soil spots 430, 432 disposed on baking pan 424. In some embodiments of the invention, one or more captured images of the baking pan may be analyzed to identify spots 430, 432, and boundaries, e.g., bounding boxes 434, 436, may be determined for each spot such that a sweep or control path for tubular spray element 414 may be determined (e.g., sweep $S_4$ for spot 430 and sweep $S_5$ for spot 432) to focus a spray of fluid onto the spot and thereby remove the spot from the baking pan.

Figure 30:
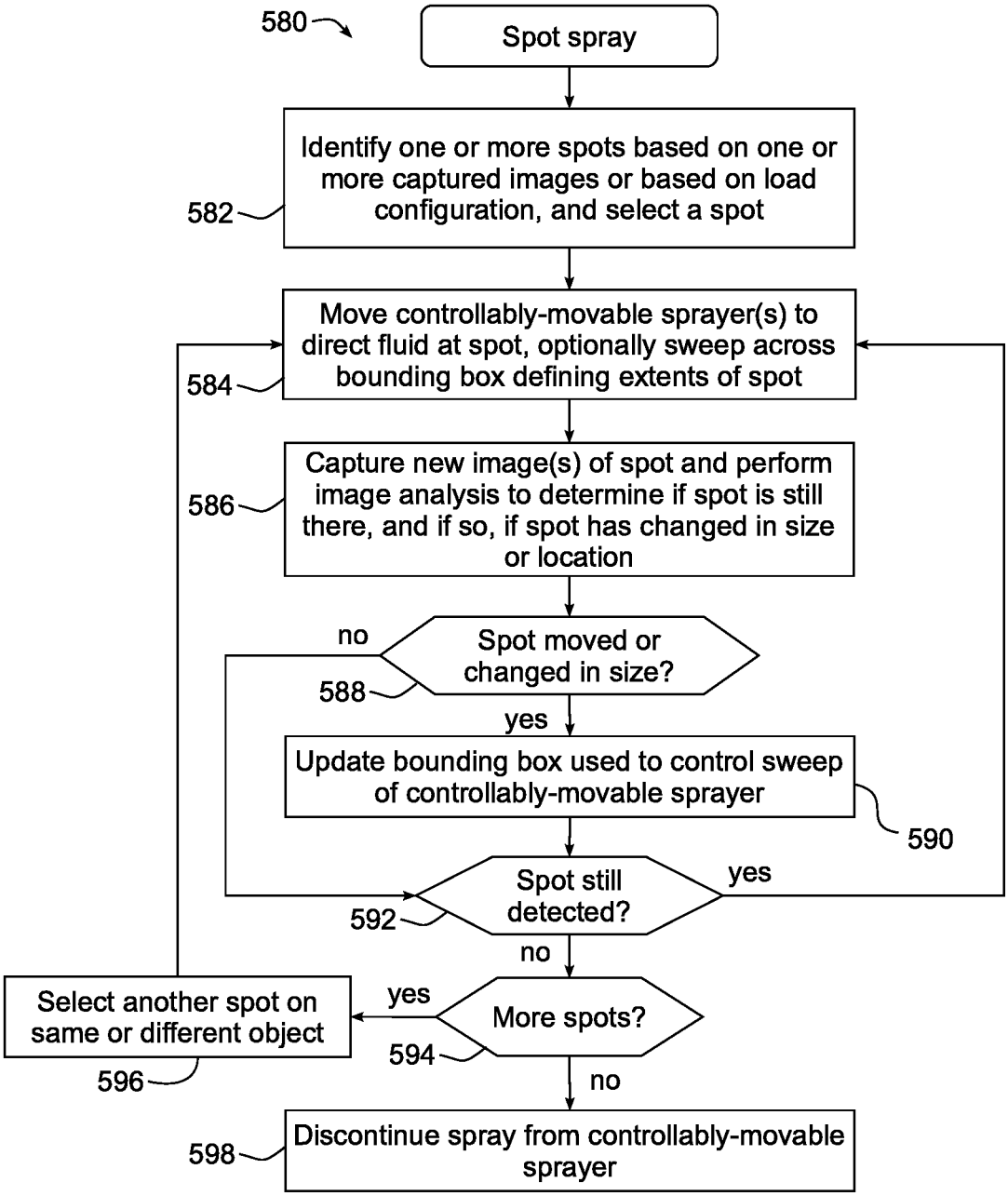
FIG. 30 is a flowchart illustrating an example sequence of operations for performing a spot spray operation using the dishwasher of FIG. 19.

FIG. 30, for example, illustrates a process 580 for performing a spot spray operation. The spot spray operation may be performed as a special mode of operation in the dishwasher, or may be performed during all modes of operation, for all or only a subset of the spots identified from image analysis. In many instances, spot spray operations may be combined with more general washing of the entirety of the load in the dishwasher, such that spot spray operations may be used to supplement general washing to address hard-to-remove soil on certain objects. In addition, in some embodiments, spot spray operations may be performed after general washing is performed. In those situations, all soiling that is easily removed by general washing will not be detected, and only the tough-to-remove soil will be identified and addressed through a subsequent operation.

Process 580 begins in block 582 by identifying one or more spots based on one or more captured images, or alternatively, based on a previously-determined load configuration, e.g., as described above in connection with FIG. 23. In addition, at this time an initial spot to clean is selected.

Next, block 584 moves one or more controllably-movable sprayers (e.g., one or more tubular spray elements) to direct fluid at the spot, either with a static spray, or optionally with a sweeping spray that covers the bounding box defining the extents of the spot. In addition, if a spot type has been determined, the pressure, temperature and/or time of spraying may be varied while spraying the spot.

In some embodiments, the spray may be set for a predetermined time, after which the spray is discontinued. In other embodiments, however, it may be desirable to visually detect when the spot has been fully removed. In such embodiments, control passes to block 586 to capture one or more new images of the spot and perform image analysis to determine if any residual spot remains, as well as to determine if the spot has changed in size or location. In some embodiments, the spray of fluid may be temporarily paused during the image capture such that the spray of fluid does not occlude the spot. In addition, in some embodiments soak times may be included to allow the spot to soften, and in some embodiments, spot spraying may alternate between different spots and in multiple passes to allow spots to soften while other spots are being cleaned. Wash parameters, e.g., pressure and/or temperature, may also be varied during multiple passes to facilitate spot removal.

If the spot has moved or changed in size, block 588 passes control to block 590 to update the bounding box used to control the direction and sweep of the controllably-movable sprayer(s), thereby effectively changing the direction of the controllably-movable sprayer(s) based on the change in location and/or size of the spot. It will be appreciated that the force of the spray of fluid onto the spot may, in some instances, cause the spot to be dislodged from its original location, so by updating the bounding box, the sprayer(s) may effectively follow the spot until the spot is completely washed away.

If the spot has not moved or changed in size, block 588 bypasses block 590. Regardless, control next passes to block 592 to determine if the spot is still detected. If so, block 592 returns control to block 584 to continue to direct spray onto the spot. If the spot is no longer detected, however, block 592 passes control to block 594 to determine if more spots (either on the same object or on a different object) remain to be cleaned. If so, block 594 passes control to block 596 to select another spot on the same or a different object, and control returns to block 584. If not, however, control passes to block 598 to discontinue the spray from the controllably-movable sprayer(s). Process 580 is then complete.

It will be appreciated that process 580 in the illustrated embodiment processes spots sequentially. In other embodiments, however, e.g., where multiple individually-controllable tubular spray elements are used in a dishwasher, multiple tubular spray elements may be controlled concurrently to spray different spots at any given time. Furthermore, in some embodiments, after repeated attempts to remove a particular spot that has not yet been fully removed, a dishwasher may generate a notification to the user asking if they would like the dishwasher to continue to work on the spot or continue with the wash cycle.

Object detection may also be used in some embodiments to detect potential problems with a load in a dishwasher. As one example, object detection may be used to detect an overturned or upward-facing object such as a cup or bowl that has either filled with wash fluid, or even prior to filling with wash fluid. In such circumstances, a dishwasher may, upon detecting the condition, generate a notification via the dishwasher user interface, a mobile app, a text message, an email, etc. to alert a user of the condition. Further, if the dishwasher is currently in a wash cycle, the wash cycle may be paused to enable the user to turn the object over and resume the wash cycle. In addition, in some instances an image of the overturned or upward-facing object may be included with the notification, and optionally with the object highlighted in the image.

Figure 31:
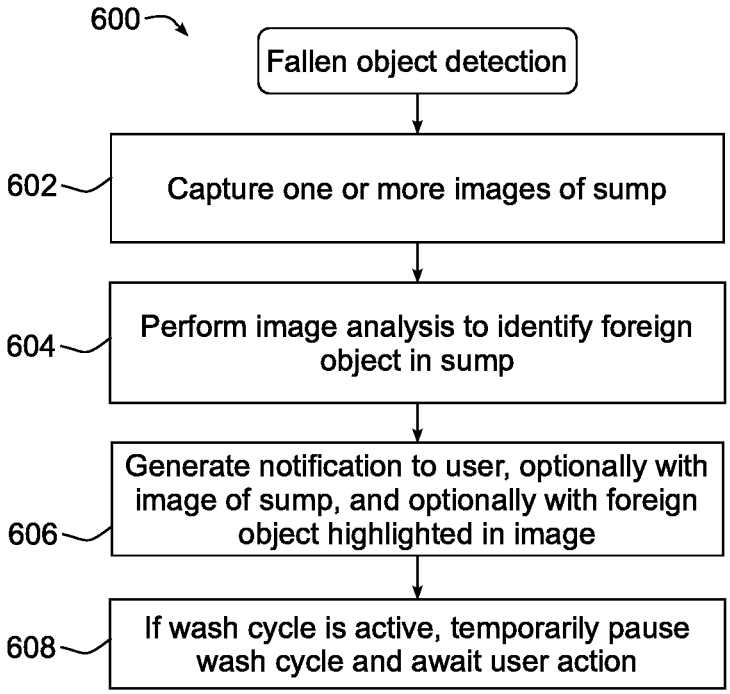
FIG. 31 is a flowchart illustrating an example sequence of operations for performing a fallen object detection operation using the dishwasher of FIG. 19.

As another example, object detection may be used in some embodiments to detect objects that have fallen into a sump area of the dishwasher. It will be appreciated, for example, that objects can block a filter in some instances and cause slow draining. Further, where a dishwasher includes a heating element in the sump, some objects, particularly objects made of plastic, may melt or become deformed if they come into contact with the heating element. As such, a process 600 as illustrated in FIG. 31 may be used in some embodiments to perform fallen object detection. Process 600 begins in block 602 by capturing one or more images of a sump of a dishwasher, and thereafter block 604 performs image analysis to identify a foreign object in the sump. Detection of the object may result in generation of a notification to a user in block 606, optionally with an image of the sump, and optionally with the image annotated to highlight the detected object. Further, if the dishwasher is currently in a wash cycle, the wash cycle may be paused in block 608 to enable the user to remove the object and resume the wash cycle.

As yet another example, similar functionality to that described above may be used to detect objects that are deforming or melting within the dishwasher. It will be appreciated that some plastics are not particularly tolerant of the heat in some dishwashers, so it may be desirable in some embodiments to detect changes in an object over time that indicate deformation or melting, and then pause the wash cycle and notify a user to avoid further deformation or melting.

Figure 32:
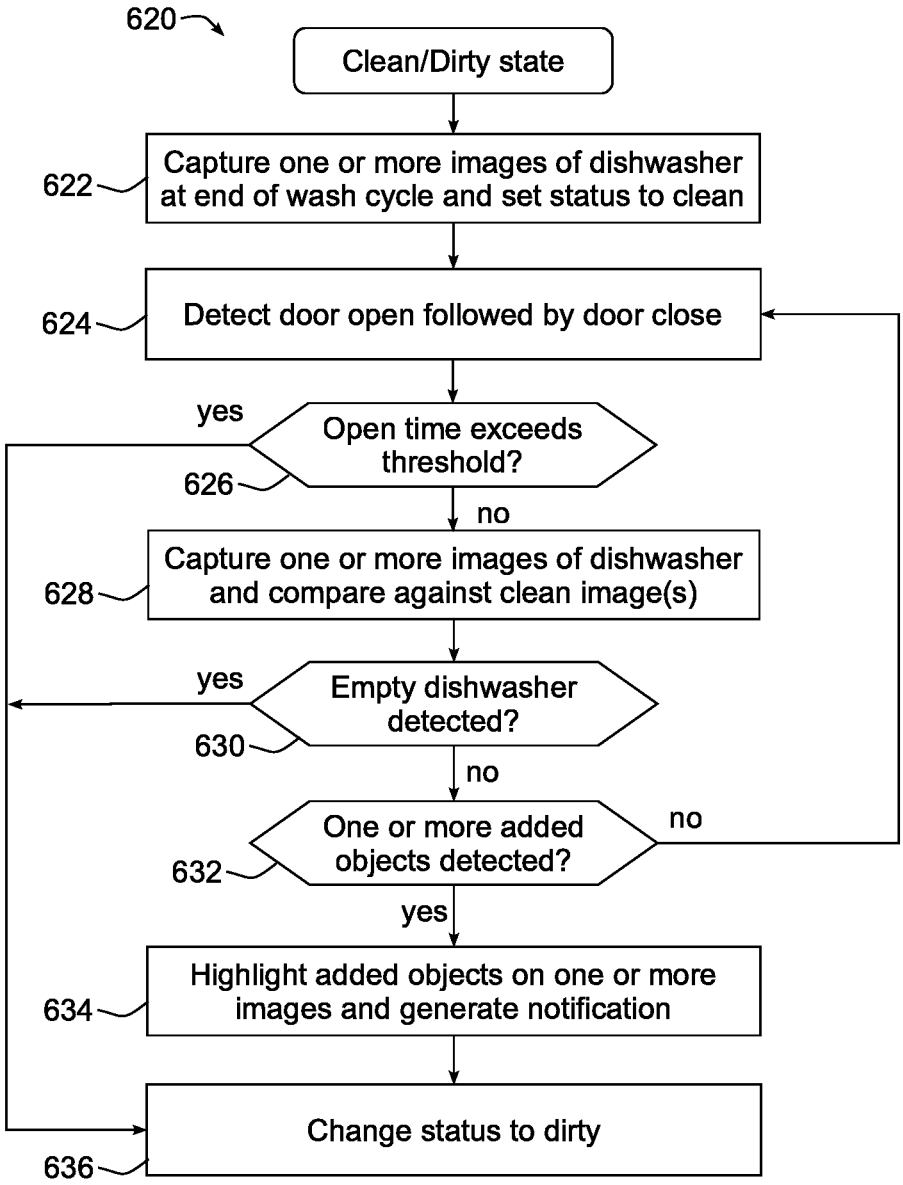
FIG. 32 is a flowchart illustrating an example sequence of operations for performing a clean/dirty state process in dishwasher of FIG. 19.

Now turning to FIG. 32, this figure illustrates a process 620 for controlling a clean/dirty state for a dishwasher. It will be appreciated that many dishwashers regularly include a light or indicator that is set to one state at the completion of a wash cycle, and then is changed to another state when the dishwasher door is opened, or when the dishwasher door is opened and then closed. Doing so, however, often fails to correctly indicate the clean or dirty state of the load in the dishwasher because even the act of manually checking the state of the dishwasher will typically change the state.

In some embodiments consistent with the invention, however, image-based object detection may be used to facilitate reporting of the clean or dirty state of a dishwasher. In particular, process 620 begins in block 622 by capturing one or more images of the dishwasher at the end of a wash cycle and setting the status of the dishwasher to clean. At this time, a notification, e.g., an indicator or other audio and/or visual indication on the dishwasher user interface, a text message, an email, a mobile app notification, etc. may be communicated to a user to indicate that the contents of the dishwasher are clean.

Block 624 next waits for a door open followed by a door close, and block 626 determines if the amount of time the door was open exceeds a threshold, e.g., a threshold consistent with the emptying of the dishwasher, on the order of one or more minutes. If not, control passes to block 628 captures one or more images of the dishwasher and compares those images against the previously-captured images of the clean load from block 622.

Block 630 next determines if an empty dishwasher has been detected, e.g., based upon detection of no load-type objects in the dishwasher. If not, control passes to block 632 to determine if one or more objects have been added to the dishwasher, e.g., by detecting one or more objects in the current images of the dishwasher that are not present in the clean images captured in block 622. If not, control may return to block 624 to wait for the door to be opened again. Of note, based on this functionality a user may be permitted to open the dishwasher and remove one or more clean items and close the door without changing the dishwasher state from clean to dirty.

If, however, one or more new objects are detected in the dishwasher, block 632 passes control to block 634 to highlight the new object(s) in the image(s) and generate a notification to the user of the addition of the object to the dishwasher. Control then passes to block 636 to change the status of the dishwasher to dirty. At this time, another notification, e.g., an indicator or other audio and/or visual indication on the dishwasher user interface, a text message, an email, a mobile app notification, etc. may also be communicated to a user to indicate that the contents of the dishwasher are dirty (or at least not presumed to be clean).

Nonetheless, based upon the notification in block 634, a user may be presented with an identification of any new objects that may have been placed in the dishwasher since it was last run, but before the contents of the dishwasher were removed. Doing so may prevent a user from treating the added objects as clean and returning the objects to his or her cupboard, or alternatively rewashing an entire load because the user did not remember what object(s) he or she added to a clean load.

Returning to block 630, if an empty dishwasher is detected, control may pass to block 636 to change the state of the dishwasher to dirty, such that any objects added to the dishwasher after being empty will be considered to be dirty objects. Likewise, returning to block 626, if it is determined that the door was opened for a sufficient period of time to empty the dishwasher, control may also pass to block 636 to change the state of the dishwasher to dirty. It will be appreciated, however, that no timer may be used in some embodiments, and as such, block 626 may be omitted in some embodiments.

Figure 33:
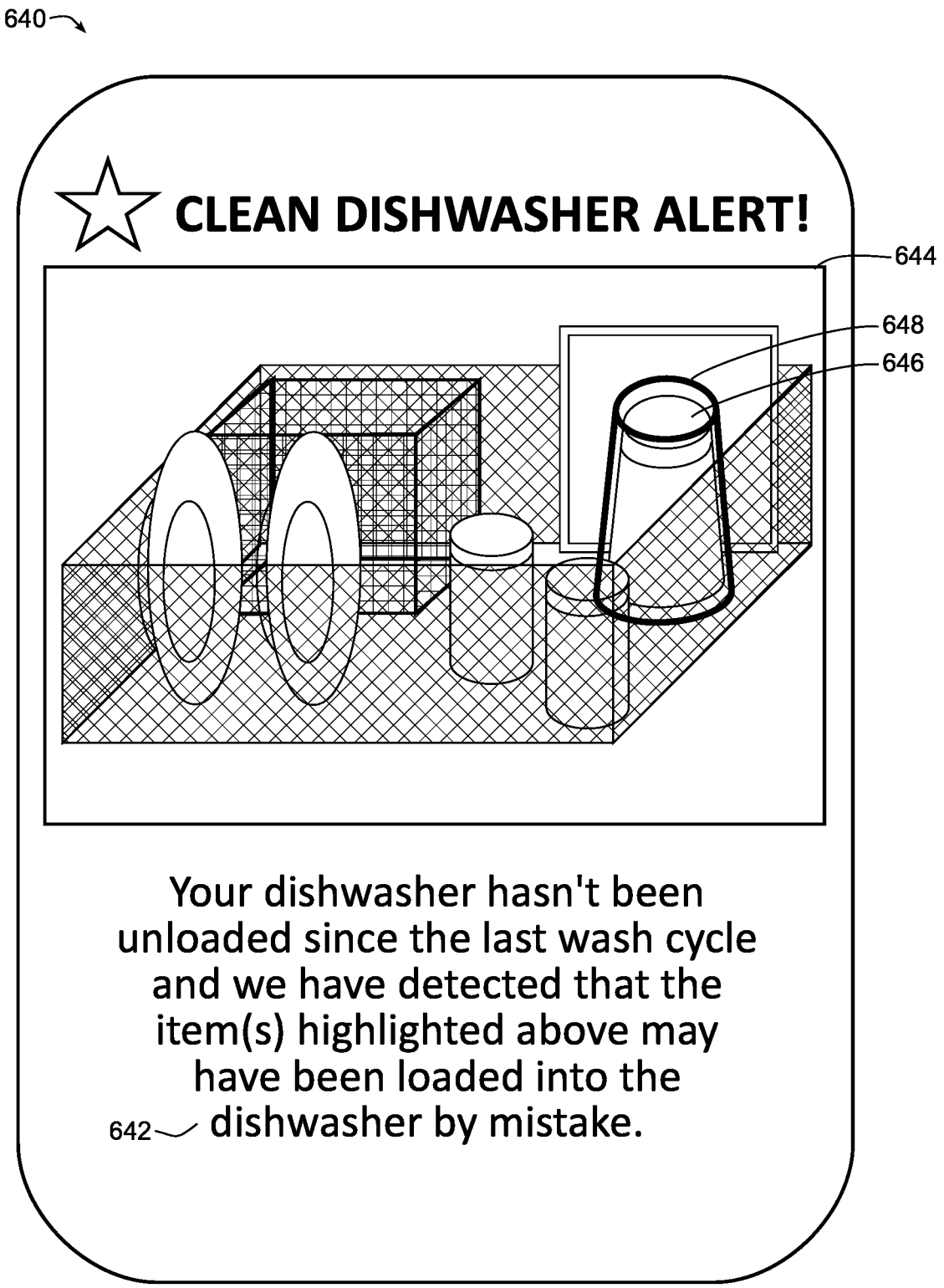
FIG. 33 illustrates an example notification generated by the dishwasher of FIG. 19 in response to detecting an added object in a clean dishwasher.

A number of different notifications may be generated in block 634, as will be appreciated by those of ordinary skill having the benefit of the instant disclosure. One such type of notification is illustrated at 640 in FIG. 33, and illustrates a textual notification, e.g., in a mobile app or a text message, and indicating that a new and potentially dirty object has been placed into a clean dishwasher. Further, the notification may additionally include an image 644 of the relevant portion of the dishwasher. The image, as noted above, may be annotated to highlight the new object, here glass 646 that is highlighted as shown at 648. Thus, a user receiving the notification would be able to open the dishwasher and remove the highlighted glass that has mistakenly been put in the clean dishwasher.

Conclusion

It will be appreciated that the analysis of images captured by an imaging device, and the determination of various conditions reflected by the captured images, may be performed locally within a controller of a dishwasher in some embodiments. In other embodiments, however, image analysis and/or detection of conditions based thereon may be performed remotely in a remote device such as a cloud-based service, a mobile device, etc. In such instances, image data may be communicated by the controller of a dishwasher over a public or private network such as the Internet to a remote device for processing thereby, and the remote device may return a response to the dishwasher controller with result data, e.g., an identification of certain features detected in an image, an identification of a condition in the dishwasher, an value representative of a sensed condition in the dishwasher, a command to perform a particular action in the dishwasher, or other result data suitable for a particular scenario. Therefore, while the embodiments discussed above have predominantly focused on operations performed locally within a dishwasher, the invention is not so limited, and some or all of the functionality described herein may be performed externally from a dishwasher consistent with the invention.

Various additional modifications may be made to the illustrated embodiments consistent with the invention. Therefore, the invention lies in the claims hereinafter appended.

What is claimed is:

1. A dishwasher, comprising:

a wash tub;

a fluid supply configured to supply fluid to the wash tub;

an imaging device configured to capture images in the wash tub;

a controllably-movable sprayer in fluid communication with the fluid supply; and a controller coupled to the imaging device and the controllably-movable sprayer, the controller configured to control the imaging device to capture one or more images of an object in the wash tub and to control the controllably-movable sprayer to spray fluid onto the object within a plurality of positions of the controllably-movable sprayer corresponding to one or more boundaries determined for the object from the captured one or more images.

2. The dishwasher of claim 1, wherein the controller is further configured to determine the plurality of positions by performing image analysis on the captured one or more images.

3. The dishwasher of claim 1, wherein the controller is further configured to determine the plurality of positions by communicating the captured one or more images to a remote device that determines the one or more boundaries of the object, and receiving a response associated therewith from the remote device.

4. The dishwasher of claim 1, wherein the controllably-movable sprayer comprises:

a tubular spray element disposed in the wash tub and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures; and a tubular spray element drive coupled to the tubular spray element and configured to rotate the tubular spray element between a plurality of rotational positions about the longitudinal axis thereof;

wherein the plurality of positions of the controllably-movable sprayer include first and second rotational positions of the tubular spray element, and wherein the controller is coupled to the tubular spray element drive and configured to control the controllably-movable sprayer to spray fluid onto the object by controlling the tubular spray element drive to discretely direct the tubular spray element to a rotational position between the first and second rotational positions.

5. The dishwasher of claim 4, wherein the controller is configured to control the controllably-movable sprayer to spray fluid onto the object by sweeping the tubular spray element between the first and second rotational positions.

6. The dishwasher of claim 4, wherein the controller is further configured to control the controllably-movable sprayer based upon a spray pattern determined from one or more images captured from the imaging device.

7. The dishwasher of claim 1, wherein the controllably-movable sprayer is a first controllably-movable sprayer and the plurality of positions is a first plurality of positions, wherein the dishwasher further comprises a second controllably-movable sprayer, and wherein the controller is configured to control the second controllably-movable sprayer to spray fluid onto the object within a second plurality of positions of the second controllably-movable sprayer corresponding to the one or more boundaries.

8. The dishwasher of claim 7, wherein the first and second controllably- movable sprayers are in a same plane.

9. The dishwasher of claim 7, wherein the first and second controllably- movable sprayers are in different planes.

10. The dishwasher of claim 9, wherein the dishwasher further comprises a third controllably-movable sprayer disposed in a different plane from each of the first and second controllably-movable sprayers, and wherein the controller is configured to control the third controllably-movable sprayer to spray fluid onto the object within a third plurality of positions of the third controllably-movable sprayer corresponding to the one or more boundaries.

11. The dishwasher of claim 1, wherein the object is a utensil to be washed.

12. The dishwasher of claim 1, wherein the object is a component of the dishwasher.

13. The dishwasher of claim 1, wherein the object is a silverware basket.

14. A dishwasher, comprising:

a wash tub;

a fluid supply configured to supply fluid to the wash tub;

an imaging device configured to capture images in the wash tub;

a plurality of controllably-movable sprayers in fluid communication with the fluid supply; and a controller coupled to the imaging device and the plurality of controllably-movable sprayers, the controller configured to control the imaging device to capture one or more images of a plurality of zones in the wash tub and to control the plurality of controllably-movable sprayers to perform concurrent wash operations in the plurality of zones using different wash cycle configurations for the plurality of zones and determined using the captured one or more images.

15. The dishwasher of claim 14, wherein the dishwasher further comprises a door providing external access to the wash tub, wherein the plurality of controllably-movable sprayers includes a first and a second controllably-movable sprayer, wherein the first controllably-movable sprayer is configurable to emit fluid in a plurality of spray patterns, and wherein the controller is further configured to:

assign one of the plurality of spray patterns for the first controllably-movable sprayer based upon a load configuration for a load in the dishwasher and determined from the captured one or more images;

control the first controllably-movable sprayer to spray fluid using the assigned spray pattern;

control the second controllably-movable sprayer to spray fluid onto a soil spot on a utensil disposed in the wash tub during a wash cycle based upon a location of the soil spot determined from one or more images of the utensil captured by the imaging device;

set a clean status for the dishwasher at the end of the wash cycle;

sense a change in state for the dishwasher based at least in part on one or more subsequent images captured with the imaging device after the door has been opened after the end of the wash cycle; and generate a notification of the change of state in response to sensing the change of state.

16. The dishwasher of claim 14, wherein the controller is further configured to determine the different wash cycle configurations by performing image analysis on the captured one or more images to determine a load configuration for a load in the dishwasher.

17. The dishwasher of claim 14, wherein the controller is further configured to determine the different wash cycle configurations by communicating the captured one or more images to a remote device that determines a load configuration for a load in the dishwasher, and receiving a response associated therewith from the remote device.

18. The dishwasher of claim 14, wherein the wash cycle configurations differ from one another based upon wash temperature, operation duration, number of operations, spray pattern, fluid pressure, soak time, or spray isolation.

19. The dishwasher of claim 14, wherein the wash cycle configurations differ from one another based upon one or more control parameters for the plurality of controllably-movable sprayers, the one or more control parameters including a zone assignment, a sweep, a control path, a rate of movement, or a position.

20. The dishwasher of claim 19, wherein each of the plurality of controllably-movable sprayers comprises:

a tubular spray element disposed in the wash tub and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures; and a tubular spray element drive coupled to the tubular spray element and configured to rotate the tubular spray element between a plurality of rotational positions about the longitudinal axis thereof.

21. The dishwasher of claim 14, wherein the controller is further configured to determine the plurality of zones for concurrent wash operations based upon resource availability.

* * * * *